US011384751B2

(12) United States Patent
Wikswo et al.

(10) Patent No.: US 11,384,751 B2
(45) Date of Patent: Jul. 12, 2022

(54) MULTICHANNEL PUMPS AND APPLICATIONS OF SAME

(71) Applicant: VANDERBILT UNIVERSITY, Nashville, TN (US)

(72) Inventors: John P. Wikswo, Brentwood, TN (US); Ronald S. Reiserer, Nashville, TN (US); David K. Schaffer, Nashville, TN (US); Dmitry A. Markov, Nashville, TN (US); Clayton M. Britt, Franklin, KY (US)

(73) Assignee: VANDERBILT UNIVERSITY, Nashville, TN (US)

( * ) Notice: Subject to any disclaimer, the term of this patent is extended or adjusted under 35 U.S.C. 154(b) by 0 days.

(21) Appl. No.: 17/505,940

(22) Filed: Oct. 20, 2021

(65) Prior Publication Data

US 2022/0042506 A1 Feb. 10, 2022

Related U.S. Application Data

(60) Division of application No. 17/269,329, filed as application No. PCT/US2019/047190 on Aug. 20, (Continued)

(51) Int. Cl.
*F04B 43/12* (2006.01)
*F04B 43/00* (2006.01)

(52) U.S. Cl.
CPC ..... *F04B 43/1269* (2013.01); *F04B 43/0072* (2013.01); *F04B 43/12* (2013.01); *F04B 43/1292* (2013.01)

(58) Field of Classification Search
CPC ..... F04B 43/1269; F04B 43/0054; F04B 43/1292; F04B 43/12; F04B 43/1253;
(Continued)

(56) References Cited

U.S. PATENT DOCUMENTS 992,205 A * 5/1911 Still ..... G03B 42/025 378/167
3,684,408 A * 8/1972 Maclin ..... F04B 43/1207 417/475

(Continued)

*Primary Examiner* — Nathan C Zollinger
(74) *Attorney, Agent, or Firm* — Locke Lord LLP; Tim Tingkang Xia, Esq.

(57) ABSTRACT

A push-pull micropump includes one or more pairs of channels configured to transfer one or more fluids, each channel pair having an aspiration channel and an injection channel; and an actuator configured to engage the one or more pairs of channels, wherein the actuator comprises a plurality of rolling members and a driving member configured such that when the driving member rotates, the plurality of rolling members rolls along the one or more pairs of channels to cause individually the one or more fluids to transfer through each channel pair simultaneously at different flowrates or the same flowrate, depending upon actuated lengths of the aspiration and injection channels of each channel pair, wherein an actuated length of a channel is defined by a length of the channel along which the plurality of rolling members rolls during a full rotation of the driving member.

5 Claims, 20 Drawing Sheets

Related U.S. Application Data

2019, now abandoned, and a continuation-in-part of application No. 15/820,506, filed on Nov. 22, 2017, now Pat. No. 10,487,819, which is a division of application No. 13/877,925, filed as application No. PCT/US2011/055432 on Oct. 7, 2011, now abandoned, said application No. PCT/US2019/047190 is a continuation-in-part of application No. 16/049,025, filed on Jul. 30, 2018, now Pat. No. 10,444,223, which is a continuation of application No. 14/363,074, filed as application No. PCT/US2012/068771 on Dec. 10, 2012, now Pat. No. 10,078,075, said application No. PCT/US2019/047190 is a continuation-in-part of application No. 16/012,900, filed on Jun. 20, 2018, now Pat. No. 10,577,574, which is a division of application No. 15/191,092, filed on Jun. 23, 2016, now Pat. No. 10,023,832, which is a continuation-in-part of application No. 13/877,925, filed on Jul. 16, 2013, now abandoned, and a continuation-in-part of application No. 14/363,074, filed on Jun. 5, 2014, now Pat. No. 10,078,075, and a continuation-in-part of application No. 14/646,300, filed as application No. PCT/US2013/071026 on May 20, 2015, now Pat. No. 9,874,285, said application No. 15/191,092 is a continuation-in-part of application No. 14/651,174, filed as application No. PCT/US2013/071324 on Nov. 21, 2013, now Pat. No. 9,618,129, said application No. PCT/US2019/047190 is a continuation-in-part of application No. 16/511,379, filed on Jul. 15, 2019, now Pat. No. 10,464,064, which is a division of application No. 15/776,524, filed as application No. PCT/US2016/063586 on Nov. 23, 2016, now Pat. No. 10,532,354, which is a continuation-in-part of application No. 13/877,925, filed on Jul. 16, 2013, now abandoned, said application No. 15/191,092 is a continuation-in-part of application No. 14/363,074, filed on Jun. 5, 2014, now Pat. No. 10,078,075, said application No. PCT/US2016/063586 is a continuation-in-part of application No. 14/646,300, filed on May 20, 2015, now Pat. No. 9,874,285, and a continuation-in-part of application No. 14/651,174, filed on Jun. 10, 2015, now Pat. No. 9,618,129, and a continuation-in-part of application No. 15/191,092, filed on Jun. 23, 2016, now Pat. No. 10,023,832, said application No. PCT/US2019/047190 is a continuation-in-part of application No. PCT/US2019/034285, filed on May 29, 2019, which is a continuation-in-part of application No. 15/776,524, filed on May 16, 2018, now Pat. No. 10,532,354, and a continuation-in-part of application No. 16/012,900, filed on Jun. 20, 2018, now Pat. No. 10,577,574.

(60) Provisional application No. 62/868,303, filed on Jun. 28, 2019, provisional application No. 62/719,868, filed on Aug. 20, 2018, provisional application No. 61/390,982, filed on Oct. 7, 2010, provisional application No. 61/717,441, filed on Oct. 23, 2012, provisional application No. 61/697,204, filed on Sep. 5, 2012, provisional application No. 61/569,145, filed on Dec. 9, 2011, provisional application No. 62/183,571, filed on Jun. 23, 2015, provisional application No. 62/193,029, filed on Jul. 15, 2015, provisional application No. 62/276,047, filed on Jan. 7, 2016, provisional application No. 62/295,306, filed on Feb. 15, 2016, provisional application No. 61/729,149, filed on Nov. 21, 2012, provisional application No. 61/808,455, filed on Apr. 4, 2013, provisional application No. 61/822,081, filed on May 10, 2013, provisional application No. 62/259,327, filed on Nov. 24, 2015, provisional application No. 62/677,468, filed on May 29, 2018.

(58) Field of Classification Search
CPC ..... F04B 43/0072; F04B 43/043; B01L 2300/0819; B01L 2300/123; B01L 3/50273
See application file for complete search history.

(56) References Cited

U.S. PATENT DOCUMENTS

| | | | | |
|---|---|---|---|---|
| 11,135,582 | B2 * | 10/2021 | Schaffer | F04B 43/12 |
| 2002/0062105 | A1 * | 5/2002 | Tanner | A61M 5/14232 604/131 |

* cited by examiner

MULTICHANNEL PUMPS AND APPLICATIONS OF SAME

CROSS-REFERENCE TO RELATED PATENT APPLICATIONS

This application is a divisional application of U.S. patent application Ser. No. 17/269,329, filed Feb. 18, 2021, which is a national stage entry of PCT Patent Application Serial No. PCT/US2019/047190 (hereinafter "the '190 application"), filed Aug. 20, 2019, which itself claims priority to and the benefit of U.S. Provisional Patent Application Ser. Nos. 62/719,868, filed Aug. 20, 2018, and 62/868,303, Jun. 28, 2019.

The '190 application is also a continuation-in-part application of U.S. patent application Ser. No. 15/820,506, filed Nov. 22, 2017, now allowed, which is a divisional application of U.S. patent application Ser. No. 13/877,925, filed Jul. 16, 2013, now abandoned, which is a national stage entry of PCT Application Serial No. PCT/US2011/055432, filed Oct. 7, 2011, which claims priority to and the benefit of, U.S. Provisional Patent Application Ser. No. 61/390,982, filed Oct. 7, 2010.

The '190 application is also a continuation-in-part application of U.S. patent application Ser. No. 16/049,025, filed Jul. 30, 2018, which is a continuation application of U.S. patent application Ser. No. 14/363,074, filed Jun. 5, 2014, now U.S. Pat. No. 10,078,075, is a national stage entry of PCT Application Serial No. PCT/US2012/068771, filed Dec. 10, 2012, which claims priority to and the benefit of U.S. Provisional Patent Application Ser. Nos. 61/569,145, 61/697,204 and 61/717,441, filed Dec. 9, 2011, Sep. 5, 2012 and Oct. 23, 2012, respectively.

The '190 application is also a continuation-in-part application of U.S. patent application Ser. No. 16/012,900, filed Jun. 20, 2018, which is a divisional application of U.S. patent application Ser. No. 15/191,092 (the '092 application), filed Jun. 23, 2016, now U.S. Pat. No. 10,023,832, which claims priority to and the benefit of U.S. Provisional Patent Application Ser. Nos. 62/183,571, 62/193,029, 62/276,047 and 62/295,306, filed Jun. 23, 2015, Jul. 15, 2015, Jan. 7, 2016 and Feb. 15, 2016, respectively. The '092 application is also a continuation-in-part application of U.S. patent application Ser. Nos. 13/877,925, 14/363,074, 14/646,300 (the '300 application) and Ser. No. 14/651,174 (the '174 application), filed Jul. 16, 2013, Jun. 5, 2014, May 20, 2015 and Jun. 10, 2015, respectively. The '300 application, now U.S. Pat. No. 9,874,285, is a national stage entry of PCT Application Serial No. PCT/US2013/071026, filed Nov. 20, 2013, which claims priority to and the benefit of U.S. Provisional Patent Application Ser. Nos. 61/729,149, 61/808,455, and 61/822,081, filed Nov. 21, 2012, Apr. 4, 2013 and May 10, 2013, respectively. The '174 application, now U.S. Pat. No. 9,618,129, is a national stage entry of PCT Application Serial No. PCT/US2013/071324, filed Nov. 21, 2013, which claims priority to and the benefit of U.S. Provisional Patent Application Ser. Nos. 61/808,455 and 61/822,081, filed Apr. 4, 2013 and May 10, 2013, respectively.

The '190 application is also a continuation-in-part application of U.S. patent application Ser. No. 16/511,379, filed Jul. 15, 2019, which is a divisional application of U.S. patent application Ser. No. 15/776,524, filed May 16, 2018, now allowed, which is a national stage entry of PCT Application Serial No. PCT/US2016/063586 (the '586 application), filed Nov. 23, 2016, which claims priority to and the benefit of, U.S. Provisional Patent Application Ser. No. 62/259,327, filed Nov. 24, 2015. The '586 application is also a continuation-in-part application of U.S. patent application Ser. Nos. 13/877,925, 14/363,074, 14/646,300, 14/651,174 and 15/191,092, filed Jul. 16, 2013, Jun. 5, 2014, May 20, 2015, Jun. 10, 2015 and Jun. 23, 2016, respectively.

The '190 application is also a continuation-in-part application of PCT Patent Application Serial No. PCT/US2019/034285 (the '285 application), filed May 29, 2019, which claims priority to and the benefit of U.S. Provisional Patent Application Ser. No. 62/677,468, filed May 29, 2018. The '285 application is also a continuation-in-part application of U.S. patent application Ser. Nos. 15/776,524 and 16/012,900, filed May 16, 2018 and Jun. 20, 2018, respectively.

Each of the above-identified applications is incorporated herein by reference in its entirety.

Some references, which may include patents, patent applications, and various publications, are cited and discussed in the description of the invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference.

STATEMENT AS TO RIGHTS UNDER FEDERALLY-SPONSORED RESEARCH

This invention was made with government support under Grant Nos. 5UG3TR002097-02, U01CA202229 and HHSN271201700044C awarded by the National Institutes of Health, Grant No. 83573601 awarded by the U. S. Environmental Protection Agency, Grant No. 2017-17081500003 awarded by the Intelligence Advanced Research Projects Activity, and Grant No. CBMXCEL-XL1-2-001 awarded by the Defense Threat Reduction Agency through Subcontract 468746 by Los Alamos National Laboratory (LANL). The government has certain rights in the invention.

FIELD OF THE INVENTION

The invention relates generally to microfluidic systems, and more particularly to multichannel pumps and applications of the same.

BACKGROUND INFORMATION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

Bioreactors offer the unprecedented opportunity to maintain tissue explants in a close-to-physiological environment. Typically, a two-chambered bioreactor, such as the Puck neurovascular unit (NVU), is perfused by two single-channel rotary planar peristaltic micropumps (RPPM), with one for each side of the blood-brain barrier (BBB). For multiple NVU bioreactors, there will be the twice the number of motor cartridges as the bioreactors. Since the physical volume occupied by a motor cartridge and their motor control electronics can be substantially greater than that of a Puck bioreactor, it would be advantageous to have a single motor provide perfusion control to both sides of a two chambered bioreactor, and also multiple such bioreactors so as to thereby increase the parallelism and throughput of an organ-on-chip bioassay. Were the bioreactors only single chamber, one single-channel pump would be required for perfusion, and a multichannel pump would be able to perfuse the same number of single-sided bioreactors.

Therefore, a heretofore unaddressed need exists in the art to address the aforementioned deficiencies and inadequacies.

SUMMARY OF THE INVENTION

In one aspect, the invention relates to a peristaltic micropump. In one embodiment, the peristaltic micropump includes a plurality of channels, wherein each channel is flexible, has a middle channel portion, and is operably in fluidic communications with a first port and a second port, and wherein the middle channel portions of the plurality of channels are arranged in one or more concentric circles; and an actuator comprising a bearing assembly driven by a motor, wherein the bearing assembly comprises a plurality of rolling members and a bearing accommodating member for accommodating the plurality of rolling members, wherein the actuator is positioned in relation to the plurality of channels such that when the bearing accommodating member rotates, the plurality of rolling members rolls along the one or more concentric circles of the middle channel portions of the plurality of channels to cause individually fluids to transfer between the first port and the second port of each of the plurality of channels simultaneously at different flowrates.

In one embodiment, each channel is in fluidic communications with a respective fluid, wherein one of the first and second ports of each channel is an input port for inputting the respective fluid, and the other is an output port for outputting the respective fluid at a predetermined flowrate with a predetermined volume.

In one embodiment, the plurality of channels is formed in a layer of a flexible material.

In one embodiment, the flexible material comprises a polymer of polydimethylsiloxane (PDMS), or its derivatives.

In one embodiment, the actuator is configured such that when the actuator is activated, during a full rotation of the bearing accommodating member, each channel is being compressed by at least one rolling member.

In one embodiment, when the actuator is deactivated, each channel is compressed by one or more rolling members as so to prevent passive forward or reverse flows through the channels of the peristaltic micropump.

In one embodiment, each channel has a cross-section area that determines a flowrate of a fluid flowing through said channel, and wherein the cross-section area is in any one of geometric shapes.

In one embodiment, when the bearing accommodating member rotates at a central axis, each rolling member operably rolls about a respective axis that is not parallel to the central axis.

In one embodiment, the bearing accommodating member comprises a bearing cage defining a plurality of spaced-apart openings thereon, and the plurality of rolling members is accommodated in the plurality of spaced-apart openings.

In one embodiment, the plurality of spaced-apart openings defines one or more concentric circles that are operably coincident with the one or more concentric circles of the middle channel portions of the plurality of channels.

In one embodiment, each of the plurality of rolling members comprises a ball, or a roller.

In one embodiment, the bearing accommodating member comprises a hub having a plurality of shafts radially protruded from the hub, and the plurality of rolling members is rotatably attached to the plurality of shafts, respectively.

In one embodiment, each of the plurality of rolling members comprises a can follower, a cylindrical roller, or conical roller.

In one embodiment, the peristaltic micropump is a rotary planar peristaltic micropump (RPPM).

In one embodiment, the peristaltic micropump further comprises a microcontroller being in wired or wireless commutations with the actuator for controlling operations of the actuator.

In another aspect of the inventions, a peristaltic micropump has a plurality of channels configured to transfer one or more fluids; and an actuator configured to engage the plurality of channels, and rotate about a central axis, wherein the actuator comprises a plurality of rolling members and a driving member configured such that when the driving member rotates, the plurality of rolling members rolls along the plurality of channels to cause individually the one or more fluids to transfer through each of the plurality of channels simultaneously at different flowrates, wherein during a full rotation of the driving member, each channel is being compressed by at least one rolling member.

In one embodiment, the plurality of channels is formed in a layer of a flexible material.

In one embodiment, the flexible material comprises a polymer of polydimethylsiloxane (PDMS), or its derivatives.

In one embodiment, each channel has a cross-section area that determines a flowrate of a fluid flowing through said channel, and wherein the cross-section area is in any one of geometric shapes.

In one embodiment, the plurality of rolling members is disposed between the plurality of channels and the driving member.

In one embodiment, each channel has a middle channel portion, and wherein the middle channel portions of the plurality of channels are arranged in one or more concentric circles.

In one embodiment, when the driving member rotates at a central axis, each rolling member operably rolls about a respective axis that is not parallel to the central axis.

In one embodiment, the driving member comprises a bearing accommodating member configured to accommodate the plurality of rolling members.

In one embodiment, the bearing accommodating member comprises a bearing cage defining a plurality of spaced-apart openings thereon, and the plurality of rolling members is accommodated in the plurality of spaced-apart openings.

In one embodiment, the plurality of spaced-apart openings defines one or more concentric circles that are operably coincident with the one or more concentric circles of the middle channel portions of the plurality of channels.

In one embodiment, each of the plurality of rolling members comprises a ball, or a roller.

In one embodiment, the bearing accommodating member comprises a hub having a plurality of shafts radially protruded from the hub, and the plurality of rolling members is rotatably attached to the plurality of shafts, respectively.

In one embodiment, each of the plurality of rolling members comprises a can follower, a cylindrical roller, or conical roller.

In one embodiment, the peristaltic micropump is a rotary planar peristaltic micropump (RPPM).

In one embodiment, the driving member is driven by a motor.

In one embodiment, the peristaltic micropump further comprises a microcontroller being in wired or wireless commutations with the actuator for controlling operations of the actuator.

In yet another aspect, the invention relates to a pump array includes a plurality of peristaltic micropumps disclosed above, arranged in a baseplate; and a microcontroller being in wired or wireless commutations with the actuator of each of the plurality of peristaltic micropumps for individually controlling operations of the plurality of peristaltic micropumps.

In one aspect of the invention, a push-pull micropump includes one or more pairs of channels configured to transfer one or more fluids, each channel pair having an aspiration channel and an injection channel; and an actuator configured to engage the one or more pairs of channels, wherein the actuator comprises a plurality of rolling members and a driving member configured such that when the driving member rotates, the plurality of rolling members rolls along the one or more pairs of channels to cause individually the one or more fluids to transfer through each channel pair simultaneously at different flowrates or the same flowrate, depending upon actuated lengths of the aspiration and injection channels of each channel pair, wherein an actuated length of a channel is defined by a length of the channel along which the plurality of rolling members rolls during a full rotation of the driving member.

In one embodiment, each channel pair is configured such that the actuated length of the aspiration channel is longer than that of the injection channel, whereby the aspiration and injection channels of each channel pair have different flowrates.

In one embodiment, each channel pair is configured such that the actuated length of the aspiration channel is same as that of the injection channel, whereby the aspiration and injection channels of each channel pair have the same flowrate.

In one embodiment, the aspiration and injection channels of each channel pair have different cross-sectional areas.

In one embodiment, each channel has a middle channel portion, and wherein the middle channel portions of the aspiration and injection channels of each channel pair are arranged as segments of two concentric circles with different radii.

In one embodiment, when the driving member rotates at a central axis, each rolling member operably rolls about a respective axis that is not parallel to the central axis.

In one embodiment, the driving member comprises a bearing accommodating member configured to accommodate the plurality of rolling members.

In one embodiment, the bearing accommodating member comprises a bearing cage defining a plurality of spaced-apart openings thereon, and the plurality of rolling members is accommodated in the plurality of spaced-apart openings.

In one embodiment, the plurality of spaced-apart openings defines one or more concentric circles that are operably coincident with the one or more concentric circles of the middle channel portions of the one or more pairs of channels.

In one embodiment, each of the plurality of rolling members comprises a ball, or a roller.

In one embodiment, the bearing accommodating member comprises a hub having a plurality of shafts radially protruded from the hub, and the plurality of rolling members is rotatably attached to the plurality of shafts, respectively.

In one embodiment, each of the plurality of rolling members comprises a can follower, a cylindrical roller, or conical roller.

In another aspect, the invention relates to a pump array comprising a plurality of push-pull micropumps as disclosed above, arranged in a baseplate; and a microcontroller being in wired or wireless commutations with the actuator of each of the plurality of push-pull micropumps for individually controlling operations of the plurality of push-pull micropumps.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1B:
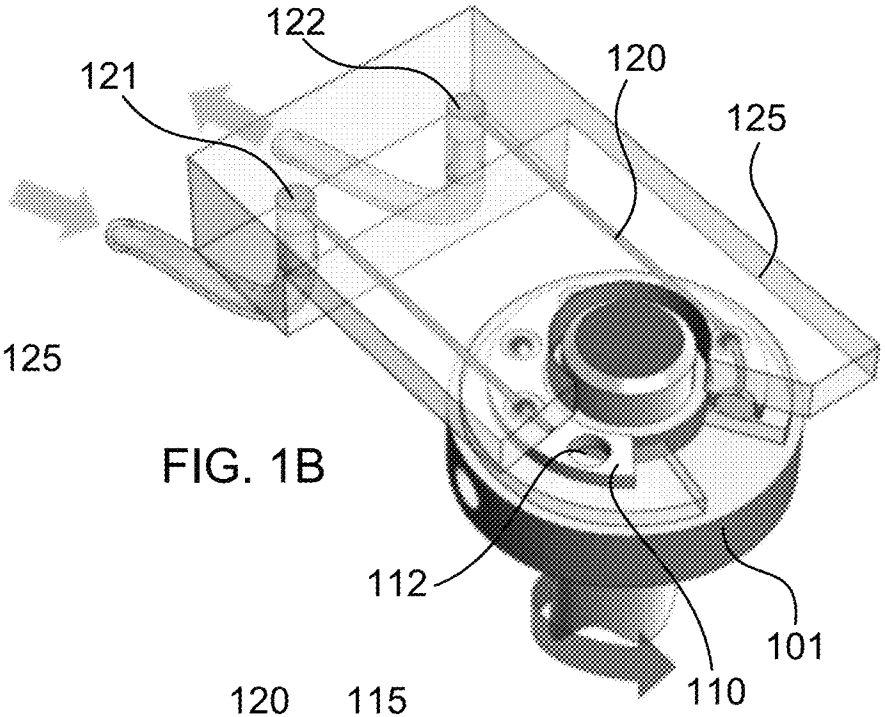
FIGS. 1A-IC show schematically different views of a peristaltic micropump with a single channel and driven by a motor.

The invention will now be described more fully hereinafter with reference to the accompanying drawings, in which exemplary embodiments of the invention are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the invention.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used herein, the terms "comprise" or "comprising," "include" or "including," "carry" or "carrying," "has/have" or "having," "contain" or "containing," "involve" or "involving" and the like are to be understood to be open-ended, i.e., to mean including but not limited to.

As used herein, the phrase "at least one of A, B, and C" should be construed to mean a logical (A or B or C), using a non-exclusive logical OR. As used herein, the term "and/or" includes any and all combinations of one or more of the associated listed items.

The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

It has been demonstrated by co-inventors of this invention in U.S. patent application Ser. Nos. 14/651,174, 14/646,300, 15/820,506 and 16/049,025, which are incorporated herein by reference in their entireties, that the exemplary embodiments of rotary planar peristaltic micropumps (RPPM) are capable of pumping a wide range of flows that are appropriate for microfluidic experiments. An RPPM can also be readily incorporated directly into a microfluidic chip, and its functionality when integrated with microfluidic networks is enhanced by a proximal and reliable means of switching fluidic inputs upstream or fluidic outputs downstream from the pump body.

Figure 1C:
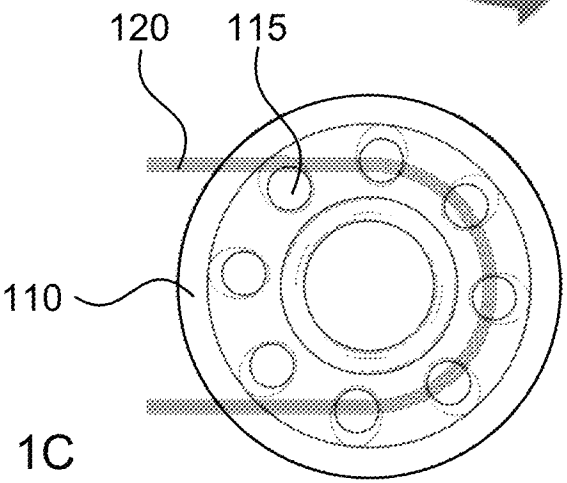
Figure 1A:
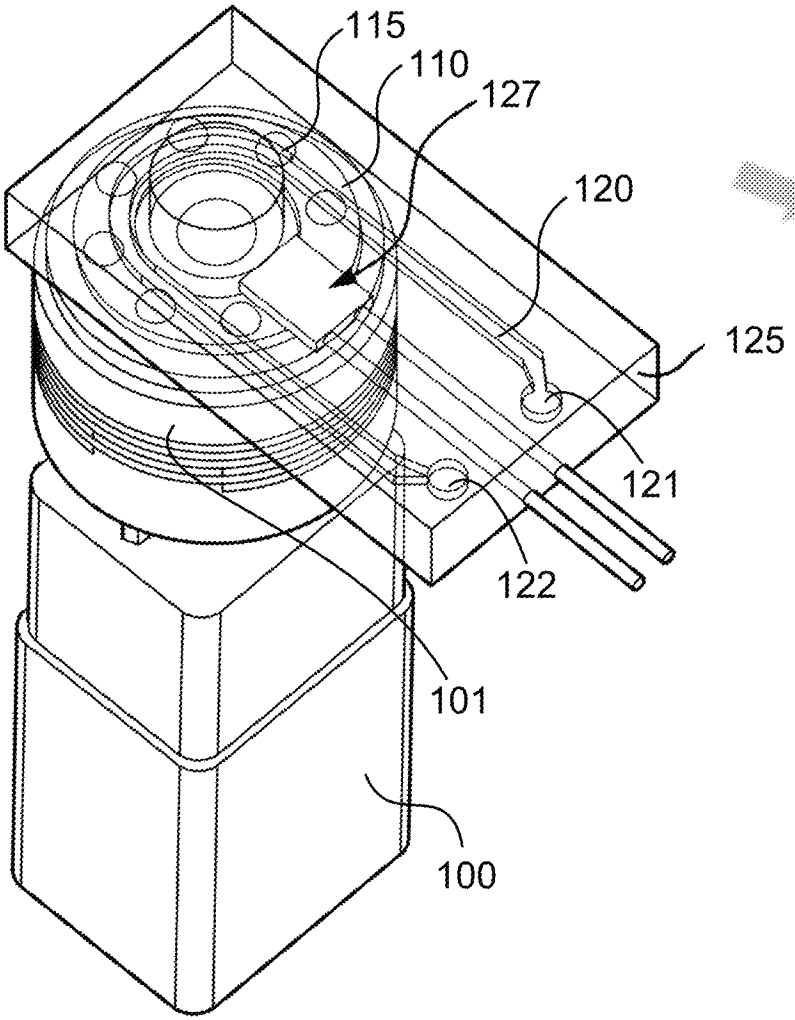

FIGS. 1A-1C schematically a RPPM with a single microfluidic channel 120. The RPPM is driven by a single motor 100 through a motor head 101 that ensures that a proper compressive force is delivered to the microfluidic channel. The RPPM includes an actuator 110 utilized for a driving force of the pump. The actuator 110 includes an eight balls 115 and a ball bearing cage 110 having eight equally spaced-apart openings 112 aligned in a circle for capturing the eight balls 115. The single microfluidic channel 120 is formed in the body of the pump formed by fluidic chip 125, with a flexible material, for example, polydimethylsiloxane (PDMS), and has a circumferential portion extended to an input port 121 and an output port 122. In operation, the actuator 110 is positioned in relation to the circumferential portion of the single channel 120. When the actuator 110 is activated/driven by the motor 100, the balls 115 roll along the circumferential portion of the single channel 120 to cause a fluid flow from the input port 121 to the output port 122 through the channel 120. In addition, as shown in FIG. 1A, a strain gauge 127 is embedded within the PDMS pump chip 125 for determining positions of the balls 115.

In certain aspects, the invention relates to single-motor-driven multichannel micropumps in which fluids are individually transferred through each of the multichannels simultaneously at controllable flowrates. The multichannel micropumps are advantageous to have a single motor provide perfusion control to multiple bioreactors and thereby increase the parallelism and throughput of an organ-on-chip bioassay.

Figure 2B:
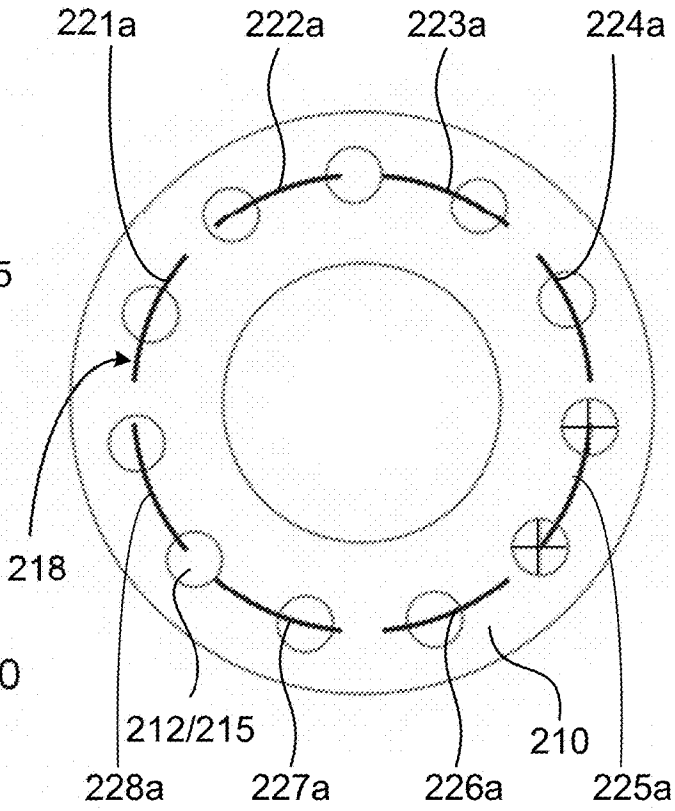
FIGS. 2A-2B shows schematically an 8-channel peristaltic micropump according to embodiments of the invention.
Figure 2A:
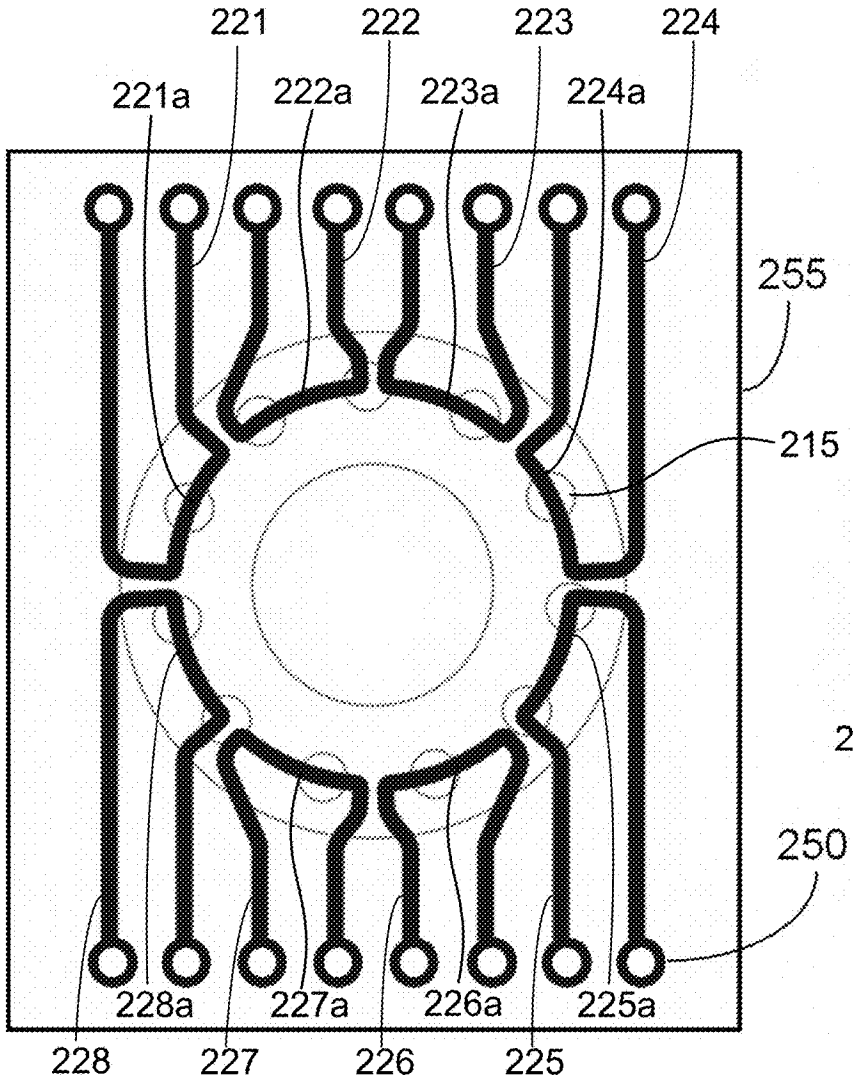

FIGS. 2A-2B show schematically an 8-channel RPPM according to one embodiment of the invention. The RPPM has eight isolated channels (fluidic circuits) 221, 223, . . . and 228, each of which has a middle, circumferential portion 221*a*, 222*a*, . . . or 228*a*. The middle channel portions 221*a*, 222*a*, . . . and 228*a* of the eight channels 221, 223, . . . and 228 are arranged in the form of one or more concentric circles. In this exemplary embodiment, they are in a single circle 218. The eight isolated fluidic circuits are actuated by a single actuator, i.e., a single motor. The actuator includes rolling members such as balls 215 in this embodiment and a bearing accommodating member such as a ball bearing cage 210 having opening 212 for accommodating the balls 215 in this embodiment. The actuator is positioned in relation to the eight channels 221, 223, . . . and 228, such that when ball bearing cage 210 rotates (driven by a single motor, not shown), the balls 215 roll along the circle 218 defined with the middle channel portions 221*a*, 222*a*, . . . and 228*a* of the channels 221-228 to cause individually fluids to transfer through each of the channels 221-228 simultaneously at different, controllable flowrates. Three of these pumps could deliver the same flowrates to each of twenty-four wells.

In one embodiment, when the bearing cage 210 rotates at a central axis, each ball 215 operably rolls about a respective axis that is not parallel to the central axis.

Figure 2C:
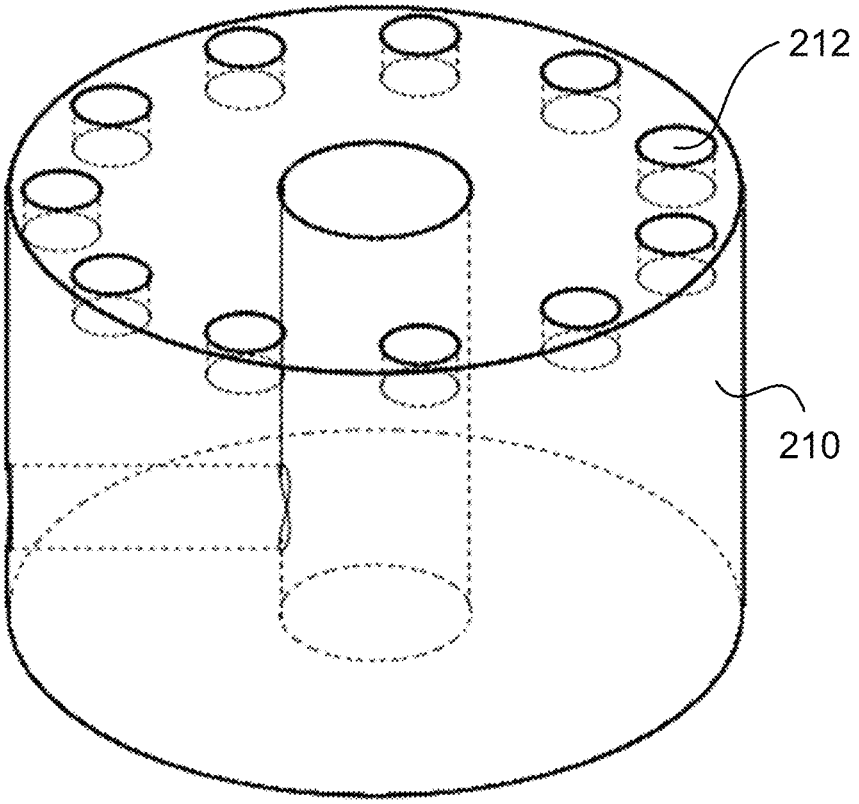
FIG. 2C shows schematically a circular, through-plate fluidic used for a peristaltic micropump according to embodiments of the invention.

In one embodiment shown in FIG. 2C, a Delrin® actuator 210 with hemispherical-bottomed sockets 212 is used to capture the balls 215 that roll against the fluidic chip that comprises the valve. As the captive balls roll, they slide within the sockets 212. Delrin®, also known as polyoxymethylene (POM), is a high-performance acetal resin with several desirable physical and mechanical properties, such as durability, stiffness, low friction, and exceptional dimensional stability, which make POM ideal for high-load and high-impact applications such as bearings, rollers, and actuators. It should be appreciated that other materials can also be utilized to practice this invention.

Figure 2D:
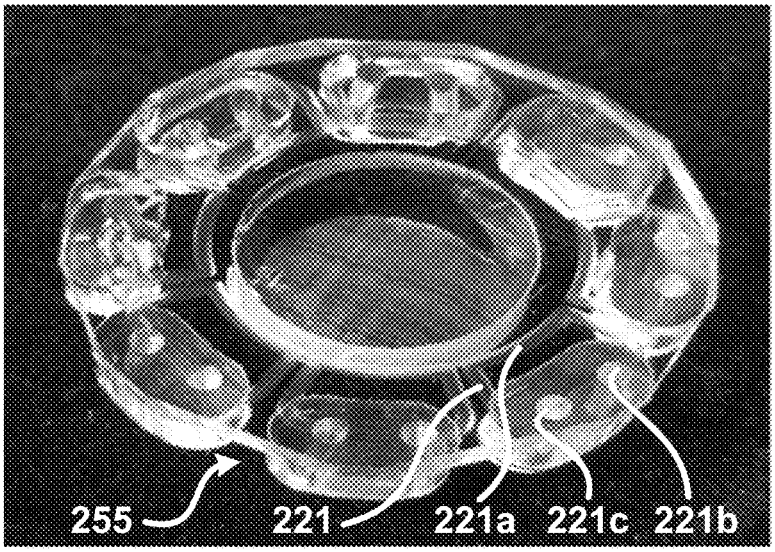
FIG. 2D shows schematically a bearing-accommodating member used for a peristaltic micropump according to embodiments of the invention.

FIG. 2D shows a circular, through-plate multichannel fluidic chip 255 according to one embodiment of the invention. The first layer of the circular fluidic chip 255 is a simple, planar layer, where the two surfaces of the first layer must be parallel to ensure uniformity of output of the m. The eight fluidic channels 221 in the upper surface of the second layer are distributed around the circumference of the chip and actuated by a single eleven-ball drive head (as shown in FIG. 2C) that presses against the upper surface of the first layer. For each of the eight channels 221, a beginning portion of the channel 221 is approximately radial and connects to the input tubing punch port 221*b*, which passes through the associated protrusion on the lower side of the second layer. The inner end of the radial channel connects to a middle, circumferential portion 221*a* of the channel 221 that performs the pumping action. The other end of the pumping channel 221 is connected to the inner end of a second, approximately radial channel, which in turn is connected to a second (output), punch port 221*c* that, in this embodiment, passes through the protrusion adjacent to the first punch port. Were the direction of rotation of the eleven-ball actuator 210 with eleven ball sockets 212 (balls not shown), as illustrated in FIG. 2C, to be reversed, the first punch port 221*b* would become the output port of that pump channel, and the second punch port 221*c* would become the input. By having eight of the input-output constructs on a single circular through-plate fluidic 255, it is possible to have eight pumps that can each pump a different fluid simultaneously.

Each channel has a cross-section area that determines a flowrate of a fluid flowing through said channel, and wherein the cross-section area is in any one of geometric shapes.

In one embodiment, the channels 221-228 are formed in a layer of a flexible material. The flexible material can be a polymer of polydimethylsiloxane (PDMS), its derivatives, or other polymer compounds.

It should be noted that FIG. 2C is just one embodiment of the pump actuator. The actuating members could be rollers on radial axles (FIGS. 8-10), balls in sockets (FIGS. 2C and 7B), or rollers, shown in FIG. 11, or balls (not shown) that roll between the pump fluidic and a rotating elastomeric drive disk or others, as disclosed in U.S. patent application Ser. Nos. 14/651,174, 14/646,300, 15/820,506 and 16/049,025, which are incorporated herein by reference in their entireties. The key point of the design is to have a sufficient number of actuating members that during the course of a full rotation no channel ever has no balls compressing it, thereby guaranteeing continuous pumping action with no depressurization of the downstream, pumped device, as could happen were a channel transiently open. On the other hand, when the pump is not operating, one or more balls on a respective channel prevent passive forward or reverse flow through the pump. In the embodiment shown, we use eleven balls to drive an eight channel pump.

In one embodiment, the multichannel pump has a microcontroller that is in wired or wireless commutations with the motor and hence actuator for controlling operations of the actuator.

Figure 2E:
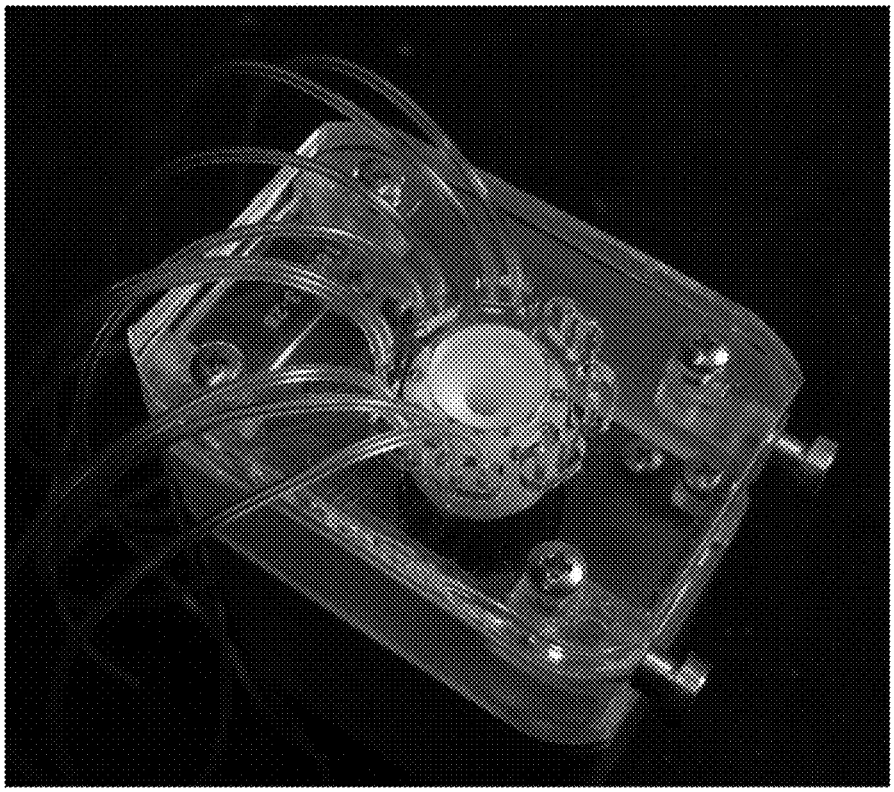
FIG. 2E shows an implementation of an eight-channel peristaltic micropump using a circular, through-plate fluidics and a totally enclosed motor cartridge according to embodiments of the invention.

FIG. 2E shows an implementation of the 8-channel pump using the circular, through-plate fluidics and the totally enclosed motor cartridge with inlet and outlet tubing connected to five of the eight channels. Three of the pump channels are not intubated with the requisite six tubes.

Figure 2F:
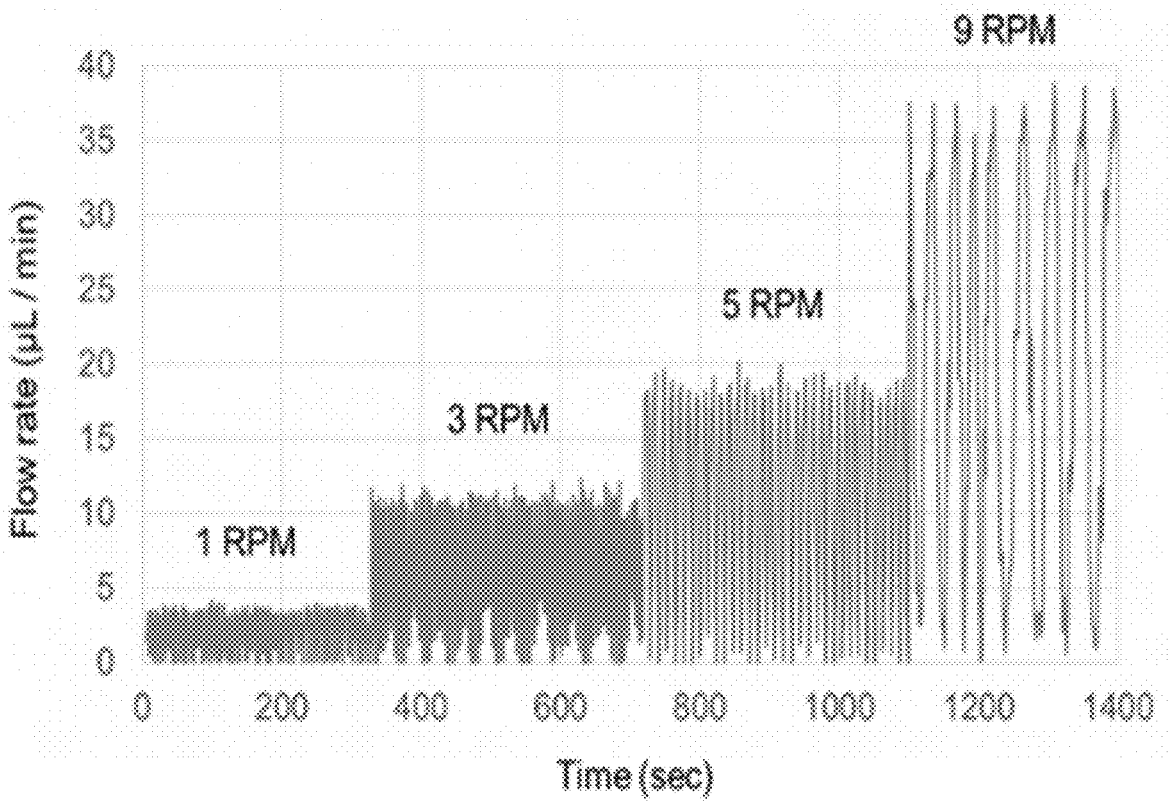
FIG. 2F shows output of one channel of an eight-channel peristaltic micropump as measured with a Dolomite flow sensor, according to embodiments of the invention.
Figure 2G:
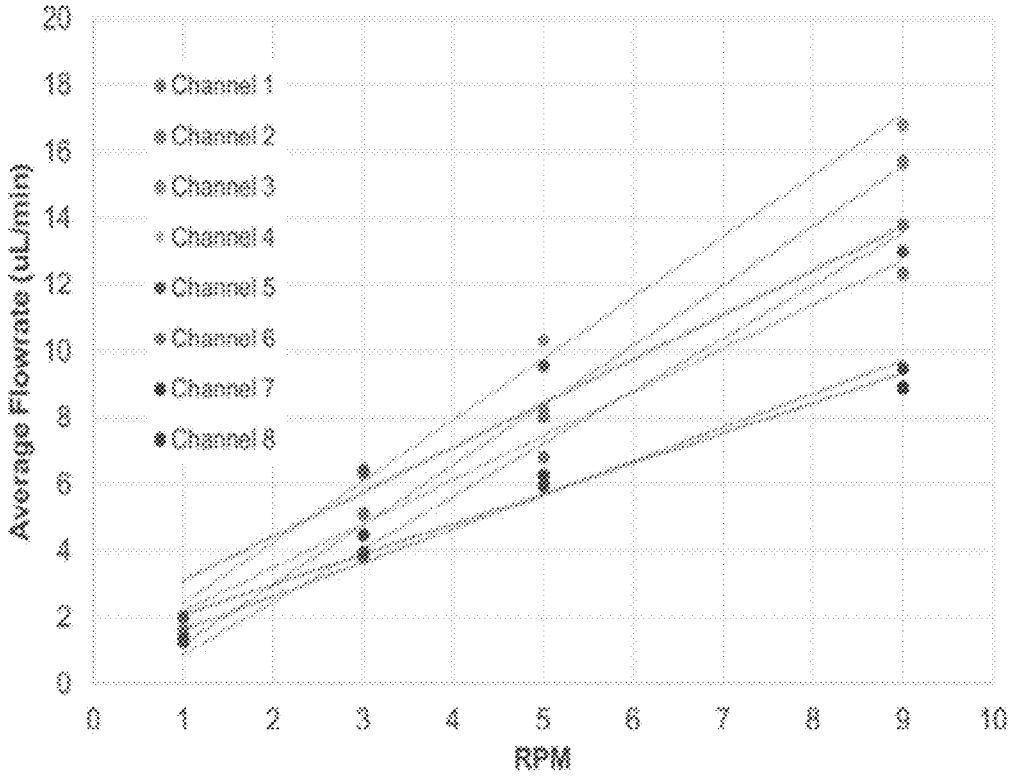
FIG. 2G shows flowrates as a function of the motor RPM for each channel of an eight-channel peristaltic micropump according to embodiments of the invention.
Figure 2H:
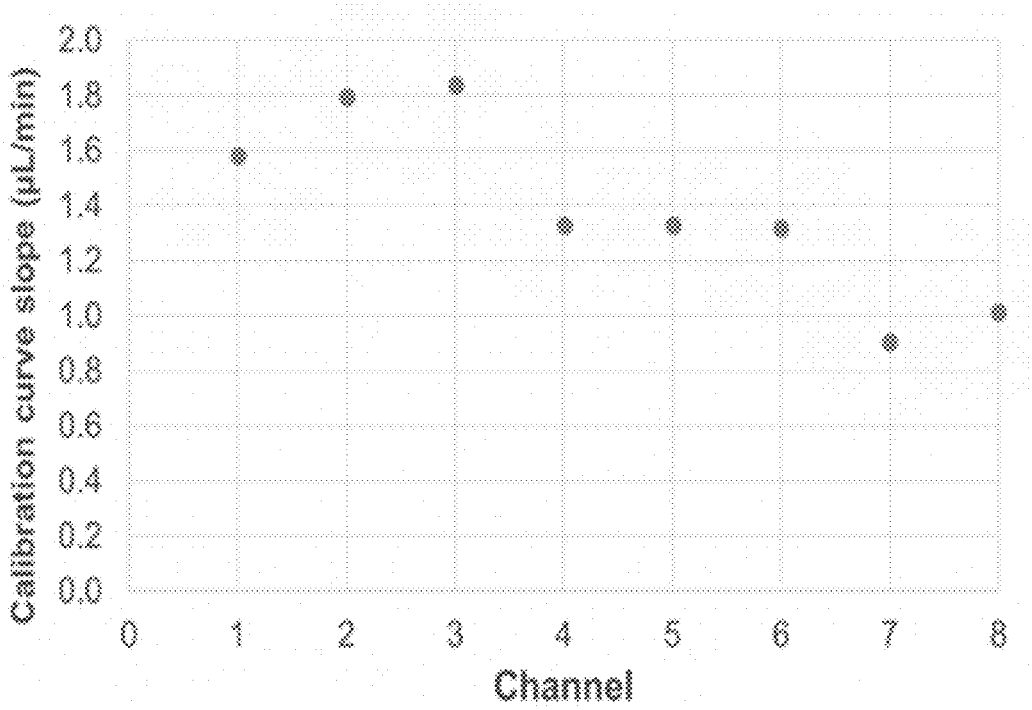
FIG. 2H shows an angular dependence the output of each channel of a prototyped eight-channel peristaltic micropump according to embodiments of the invention.

FIGS. 2F-2H show data that demonstrate the feasibility of an eight-channel, through-plate RPPM according to one embodiment of the invention. FIG. 2F shows the output of each channel as measured with a flow sensor, e.g., a Dolomite flow sensor, showing standard pulsatility. The addition of fluidic capacitors, either integral to the multi-pump fluidic chip or on an accessory chip, would dampen the pulsations. FIG. 2G shows the flowrate as a function of motor RPM. Each point is an average of about 160 sec. FIG. 2H shows that for the particular pump tested, there was an angular dependence of the flowrate delivered by each of the pump channels arrayed around the circumference of the chip. The angular dependence of the flowrate shown in FIG. 2H could be the result of either a spatially regular variation in channel depth, device thickness, elastomer stiffness, or actuator angle, or non-planarity of the actuator head and the fluidic chip, as might occur from variations in the fabrication and mechanical tolerances in the construction of the pump cartridge, all of which can be controlled by tightening the manufacturing tolerances. The addition of adjustable flow restrictors, such as TURN valves, either integral to the multi-pump fluidic chip 255 with input and output ports 250 as illustrated in FIG. 2I or on an accessory chip, would be used to balance the flows of each pumping channel.

This approach enables even more sophisticated pumping systems, for example where the pumping channels are not all identical. Some of the channels could have larger cross-sectional areas to pump faster than other channels. In one embodiment, four of the channels with smaller cross-sectional areas could deliver fluid via a long needle to the bottom of four wells in a standard well plate, as indicated by the two tubes 603 and 604 illustrated for a single well in FIG. 6D. The other four pumping channels could have larger cross-sectional areas so that they would pump faster as they withdraw fluid from the top of the fluid in the well by means of a shorter needle. Because the withdrawal needle is always pumping faster than the delivery one, the withdrawal pump will be aspirating either water or air or a mixture of the two and would thereby provide level control for each well. This would allow a single motor cartridge to provide continuous perfusion to multiple wells in a standard well plate.

Figure 2I:
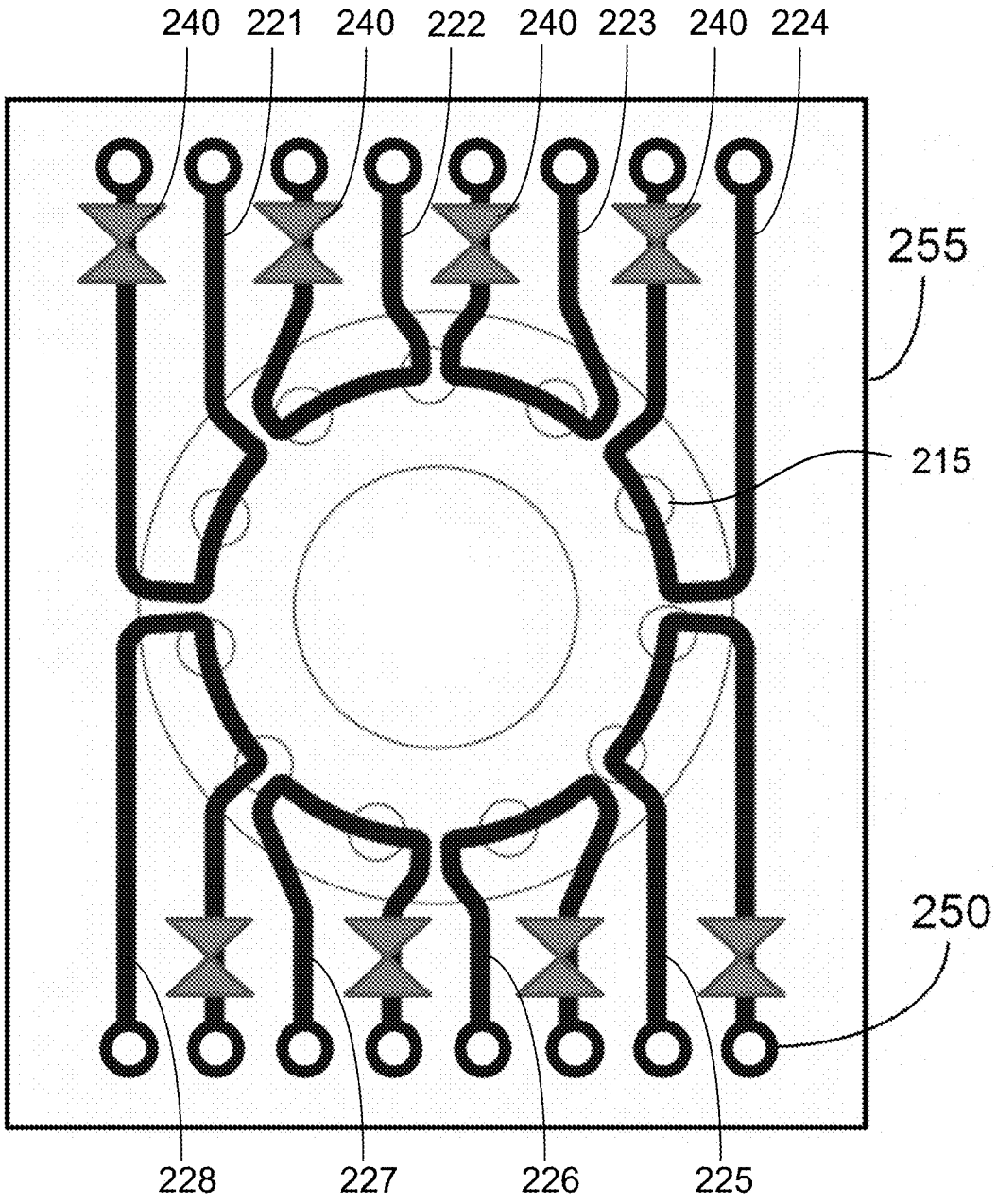
FIG. 2I shows valves-on-a-valve balancing of a multi-channel peristaltic micropump according to embodiments of the invention.

FIG. 2I shows an eight-channel pump chip 255, similar to that depicted in FIG. 2, wherein each individual circuit/channel is outfitted with a throttling valve 240, such as a TURN valve. Each of these valves 240 may be adjusted individually to alter flowrate through its corresponding channel and hence input and output ports 250. This feature may be used to balance flow across any or all channels which otherwise might be unbalanced do to restrictions or other sources of resistance or pressure elsewhere in the circuit. Throttling valves 240 may be located on the chip itself as shown in FIG. 2I, or may be included to a valving system as an off-board accessory.

Figure 3A:
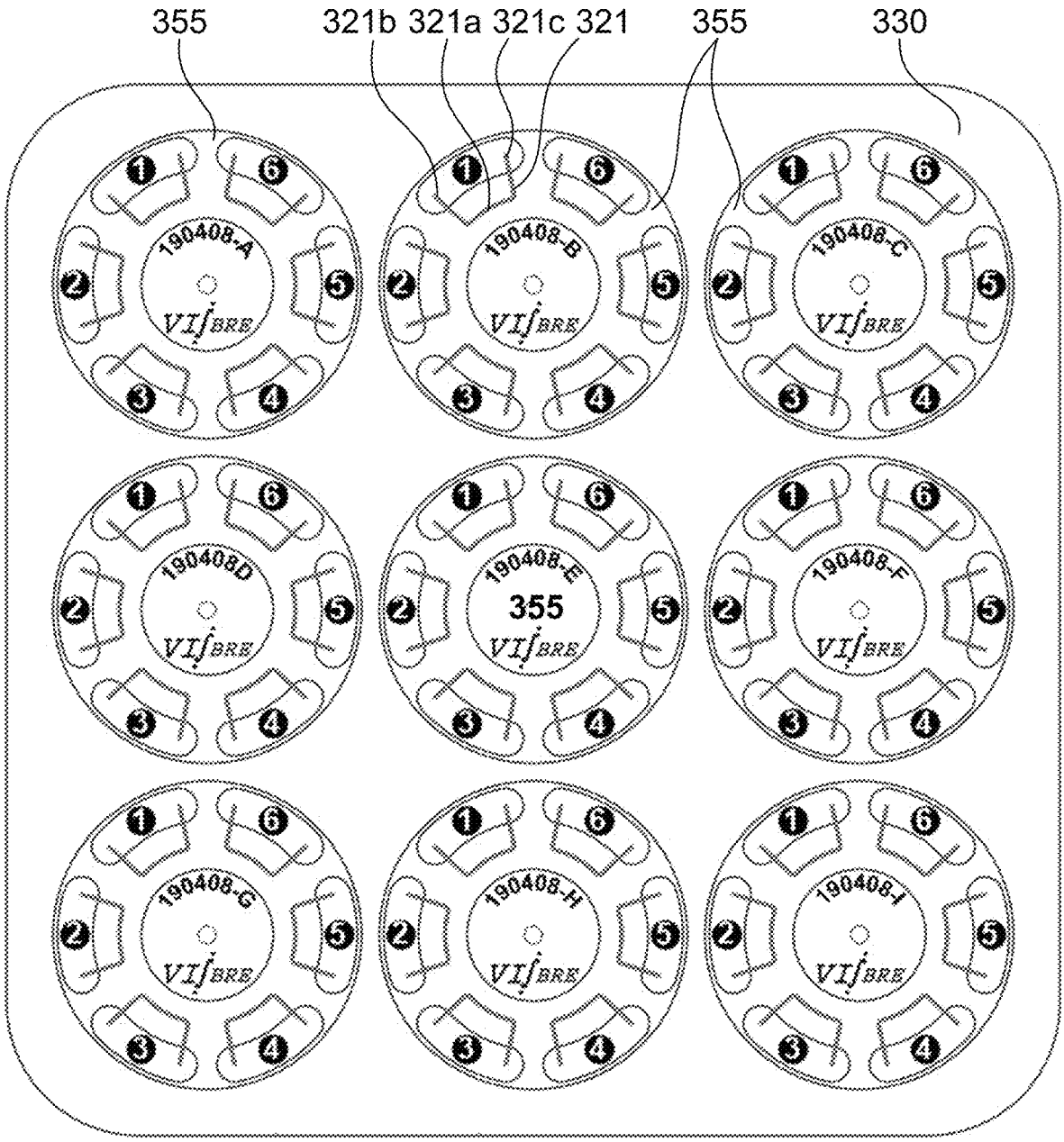
FIG. 3A shows schematically an array of pumps that can either be driven by an array or motors, or separated into individual pumps according to embodiments of the invention.
Figure 3B:
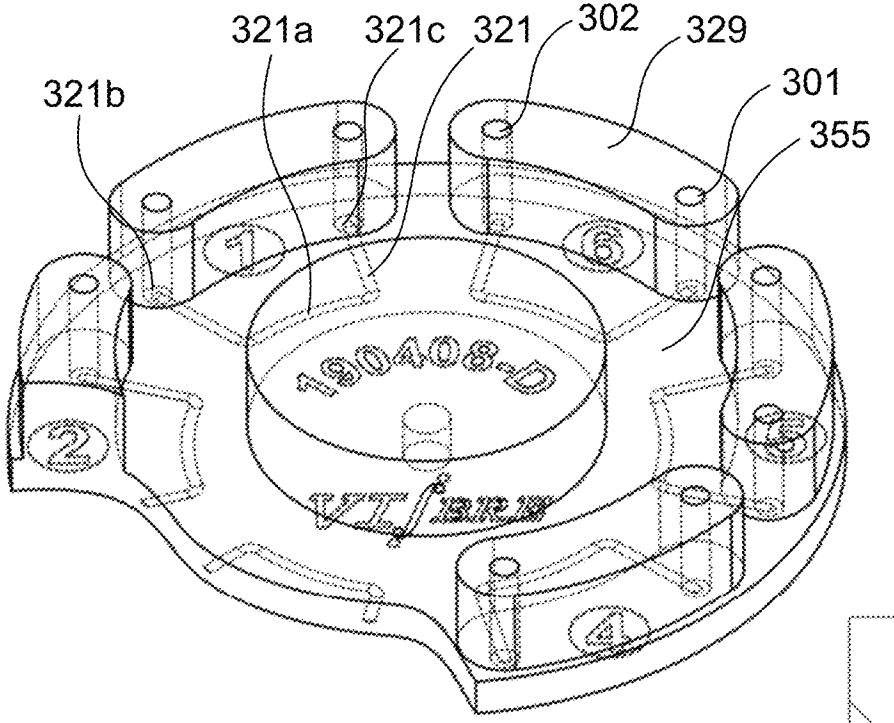
FIG. 3B shows a partial perspective view of a 6-channel pump fluidic chip utilized in the pump array shown in FIG. 3A, showing structures of the pump fluidic chip, according to embodiments of the invention.
Figure 3C:
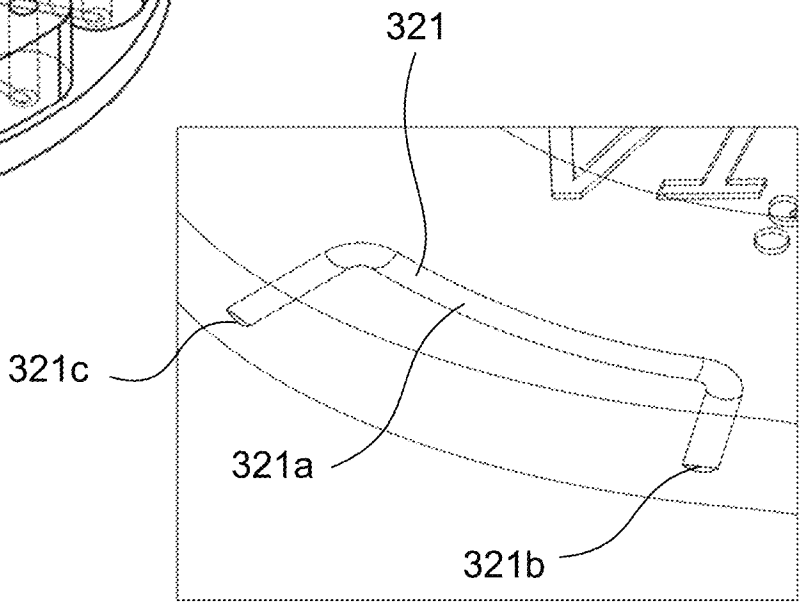
FIG. 3C shows a partial perspective view of the 6-channel pump fluidic chip shown in FIG. 3B showing a single pump channel.

FIG. 3A shows a pump array of nine 6-channel pump chips 355 placed in an alignment pocket or baseplate 330 according to one embodiment of the invention. In this embodiment, each pump chip 355 facilitates six independent pumping circuits, e.g., six fluidic channels 321. These pumps can be operated by an array of nine actuators and nine motors (not shown), or separated into individual pumps as illustrated in FIG. 2E. As shown in FIGS. 3B-3C, each channel 321 has a beginning portion approximately radial and connecting to a first port 321*b*, where the inner end of the radial channel portion connects to a middle, circumferential portion 321*a* of the channel 321 that performs the pumping action. The other end of the pumping channel 321 is connected to the inner end of a second, approximately radial channel, which in turn is connected to a second port 321*c*. The first and second ports 321*b* and 321*c* are respectively fluidic input and output ports, or fluidic output and input ports, depending upon the direction of rotation of an actuator (not shown). By having six of the input-output constructs on a single circular through-plate fluidic 355 mounted as shown in FIG. 2I, it is possible to have a single motor drive six pumps that can each pump a different fluid simultaneously. In addition, for each pump chip 355, a channel cross-sectional area of each channel 321 may be adjusted to produce balanced flowrates or different flowrates. Furthermore, the pump chip 355 also includes a plurality of protrusions, e.g., six protrusions 329 in this exemplary embodiment, configured to align the pump chip 355 to a fluidic chip support plate (not shown). Also, the protrusions 329 is further configured to function as a fluidic interface ports 301 and 302 connected to external fluidic sources, or another fluidic chips.

By aligning nine of the 6-channel pumps 355 in the baseplate 330, as shown in FIGS. 3A-3B, it would have fifty-four pumps that can each pump a different fluid simultaneously, at a different rate, by controlling each of nine actuators that operably coupled with the nine 6-channel pumps 355, respectively.

In addition, the pump array also includes a microcontroller (not shown) being in wired or wireless commutations with the actuator of each of the nine peristaltic micropumps 355 for individually controlling operations of the plurality of peristaltic micropumps 355.

In one embodiment, alignment pockets accept pins/dowels or similar features, which can be used to align chip to actuator.

In one embodiment, the number of individual circuits may be adjusted to suit operational needs.

In one embodiment, chip features markings to identify individual circuits for ease of use.

In one embodiment, chip designed for use with 12-ball actuator.

In one embodiment, channel shape/length/spacing designed such that at least one actuating ball is always pinching each channel closed (positive flow).

Figure 4A:
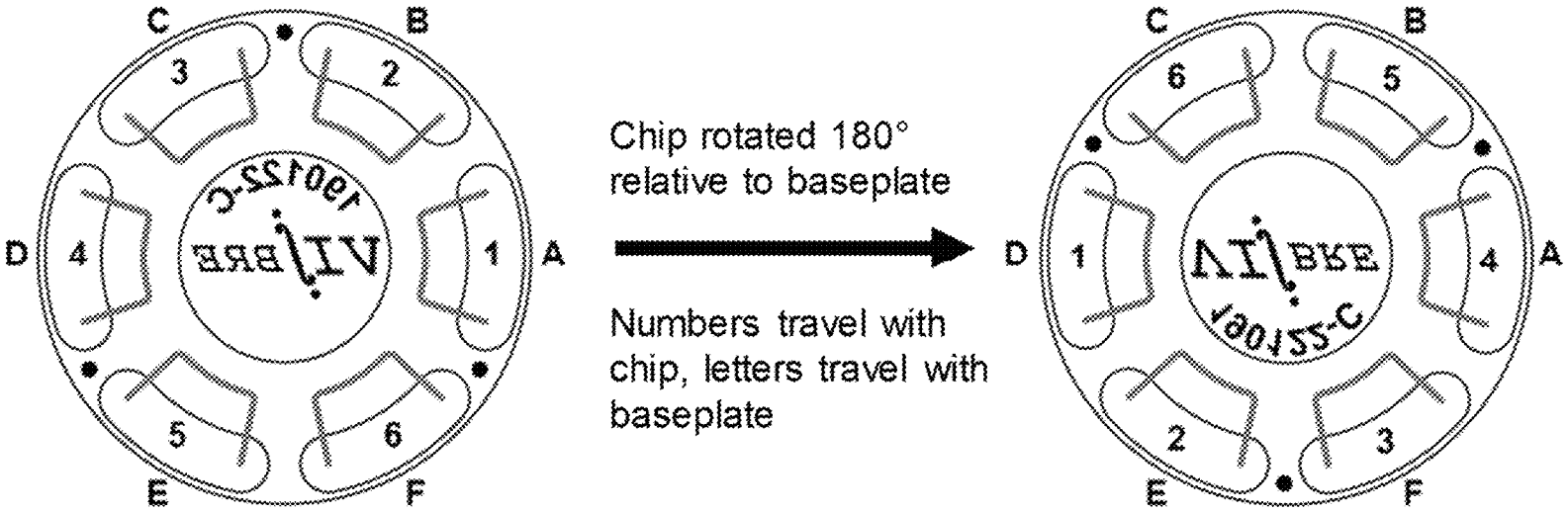
FIG. 4A shows a 6-channel pump fluidic chip and its 1800 rotation relative to the baseplate according to embodiments of the invention.
Figure 4B:
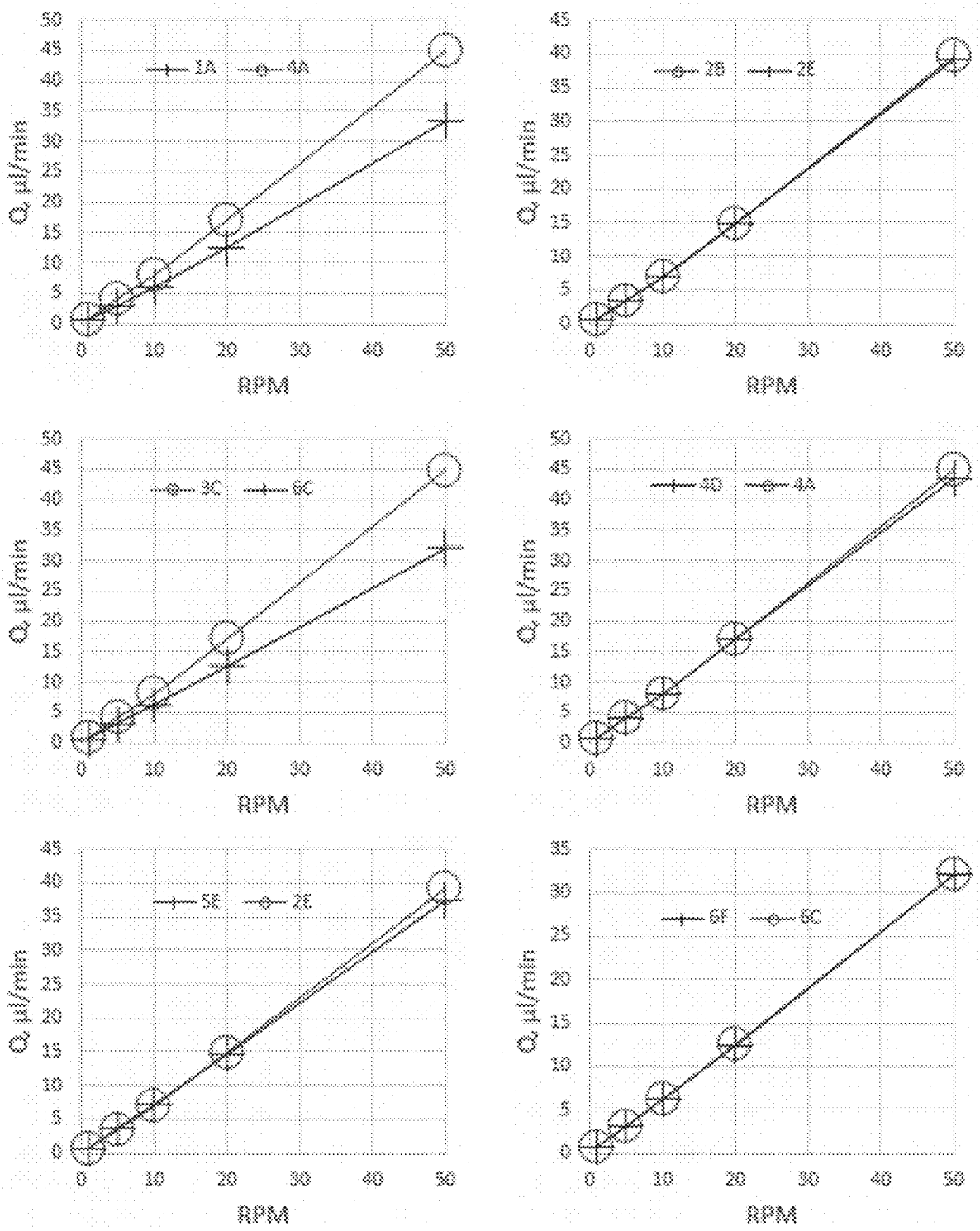
FIG. 4B shows flowrates of each channel of 6-channel pump fluidic chip of FIG. 4A before (crosses) and after the 180° rotation (circles) according to embodiments of the invention.

FIG. 4A shows a 6-channel pump chip and its 1800 rotation relative to the baseplate, which illustrating each channel position relative to the baseplate before and after the 1800 rotation is different. FIG. 4B shows the flowrates of each channel before (cross symbol) and after the 180° rotation (circle symbol), in which the left column of graphs presents the flowrates of different channels at a same position relative the baseplate, while the right column are the flowrate of a same channel at different positions relative to the baseplate. For example, the top panel of the lift column shows the flowrates of channel 1 at position A of the pump chip before the rotation, and channel 4 at position A of the pump chip before the 180° rotation, respectively, which both the flowrates are substantially different. The top panel of the right column shows the flowrates of channel 2 at position B of the pump chip before the rotation, and channel 2 at position E of the pump chip before the 1800 rotation, respectively, which both the flowrates are substantially same. These results clearly indicate that inter-channel variability in the flowrate appears to be intrinsic to the fluidic chip, rather than position of channels relative to baseplate.

Figure 5A:
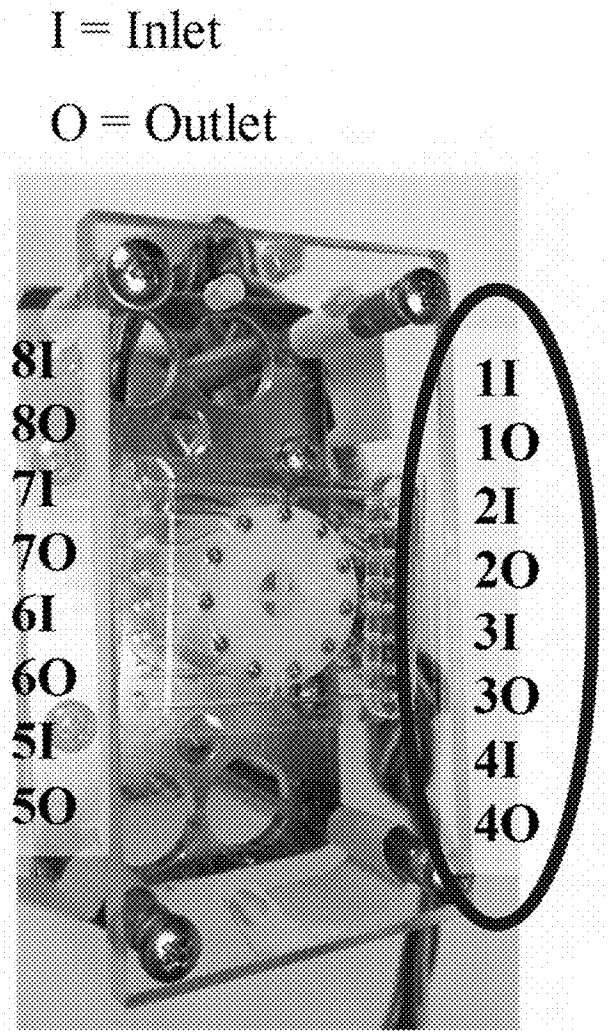
FIGS. 5A-5B show an 8-channel peristaltic micropump with identification of the input and output ports of the eight channels according to embodiments of the invention.
Figure 5B:
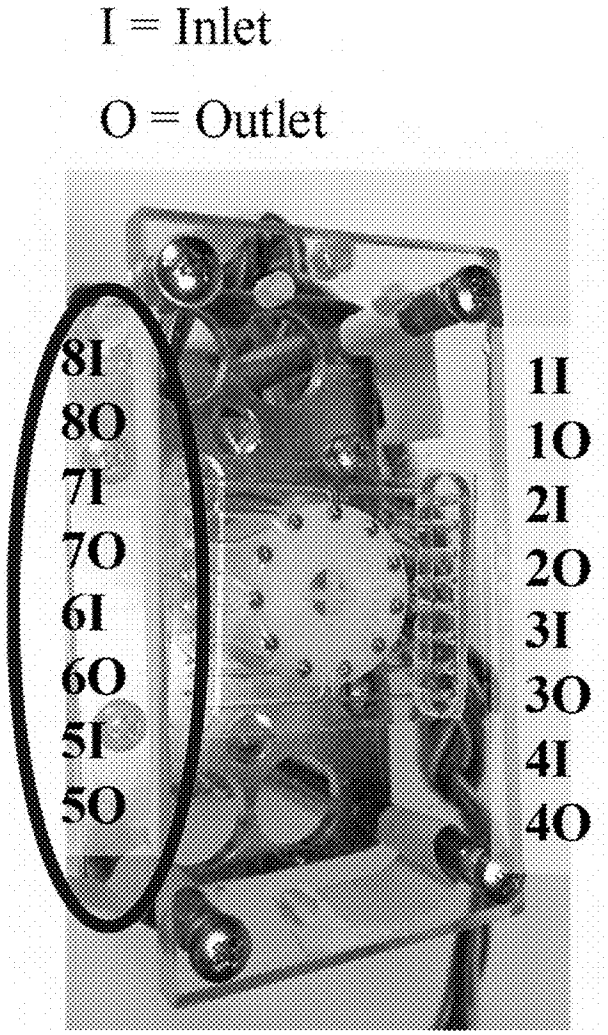
Figure 5C:
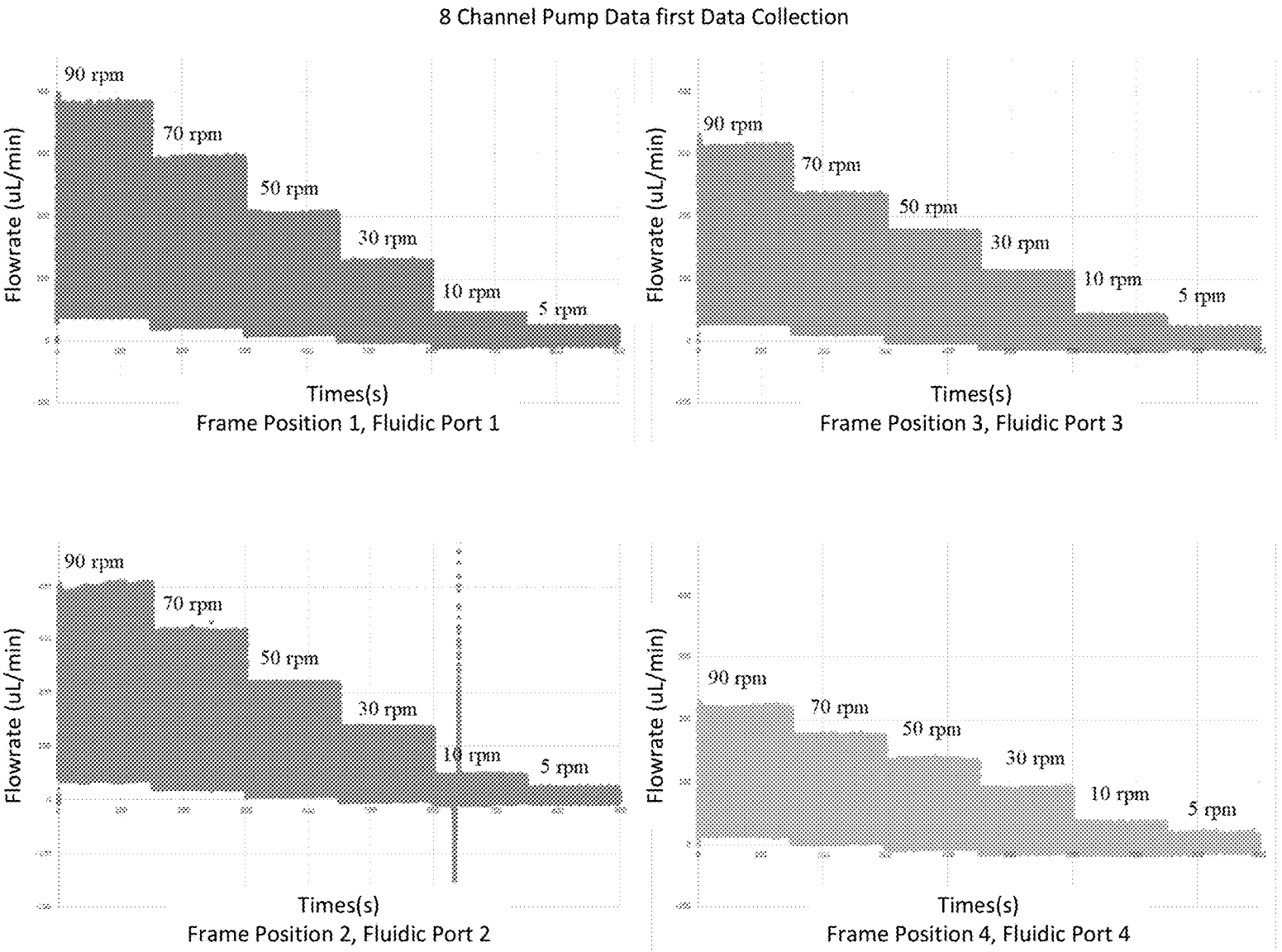
FIGS. 5C-5F show flowrate characterization for each channel of 8-channel peristaltic micropump of FIGS. 5A-5B according to embodiments of the invention.
Figure 5D:
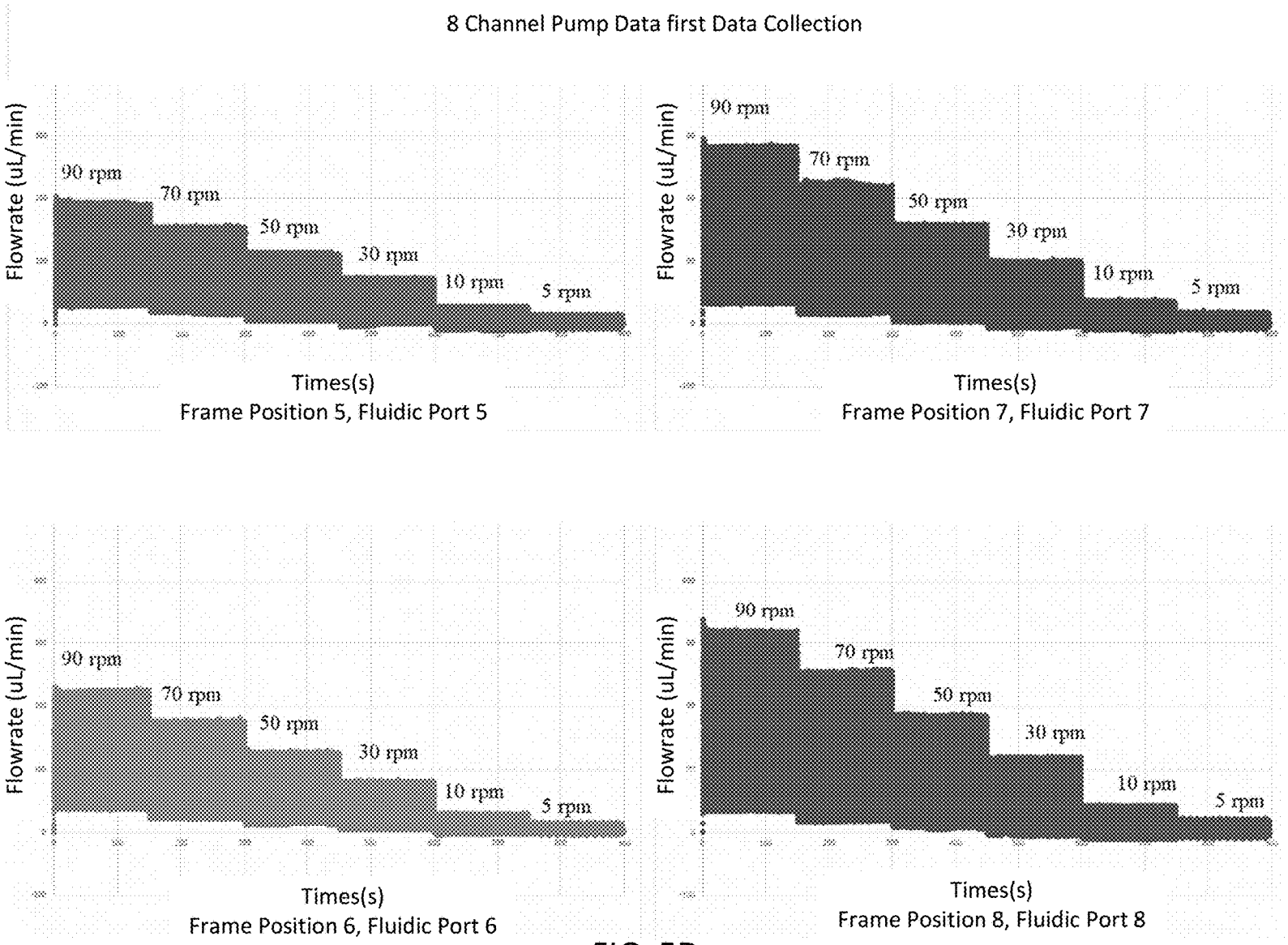

FIGS. 5A-5F show further characterization of the flowrates of an 8-channel pump according to one embodiment of the invention. FIG. 5A shows the ports tested in FIG. 5C, and FIG. 5B shows the ports tested in FIG. 5F. The experiments that generated these data were conducted to better understand the characteristics of the 8-channel pump, namely the relative flowrates through each channel, and to identify the source(s) of any variation (variations in thickness across the chip/variation in relative channel depth/variations in standoff length/variations in actuator altitude, etc.). Deionized water was delivered by the 8-channel pump to the Sensirion flow sensor to measure and record flow rates. FIGS. 5C and 5D show the resulting data. The vertical height of each band represents the amplitude of the fluctuations associated with the peristaltic pumping action. Theoretically the flow rates of each channel would be identical, but in reality for this prototype, they differed.

Figure 5E:
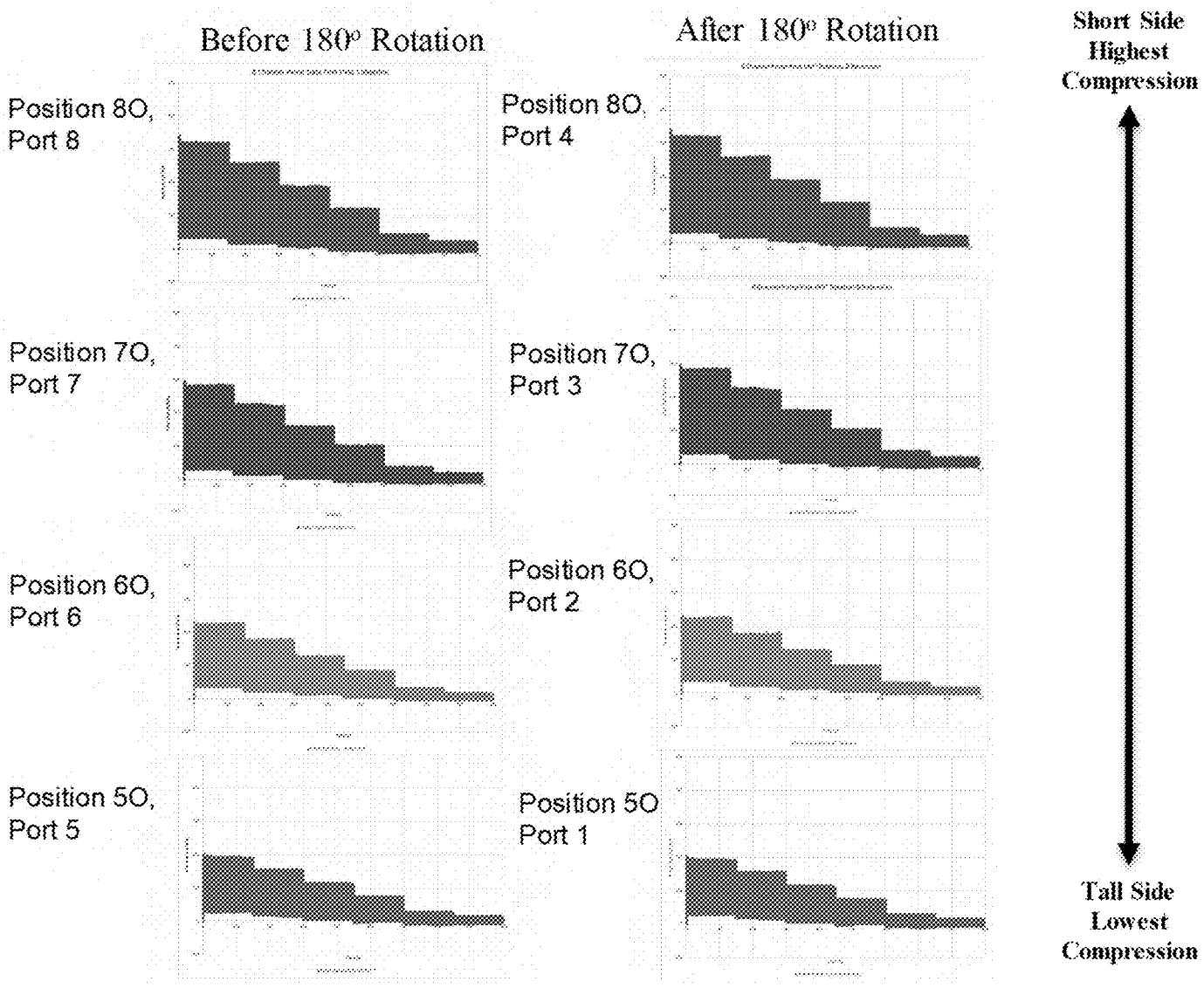
Figure 5F:
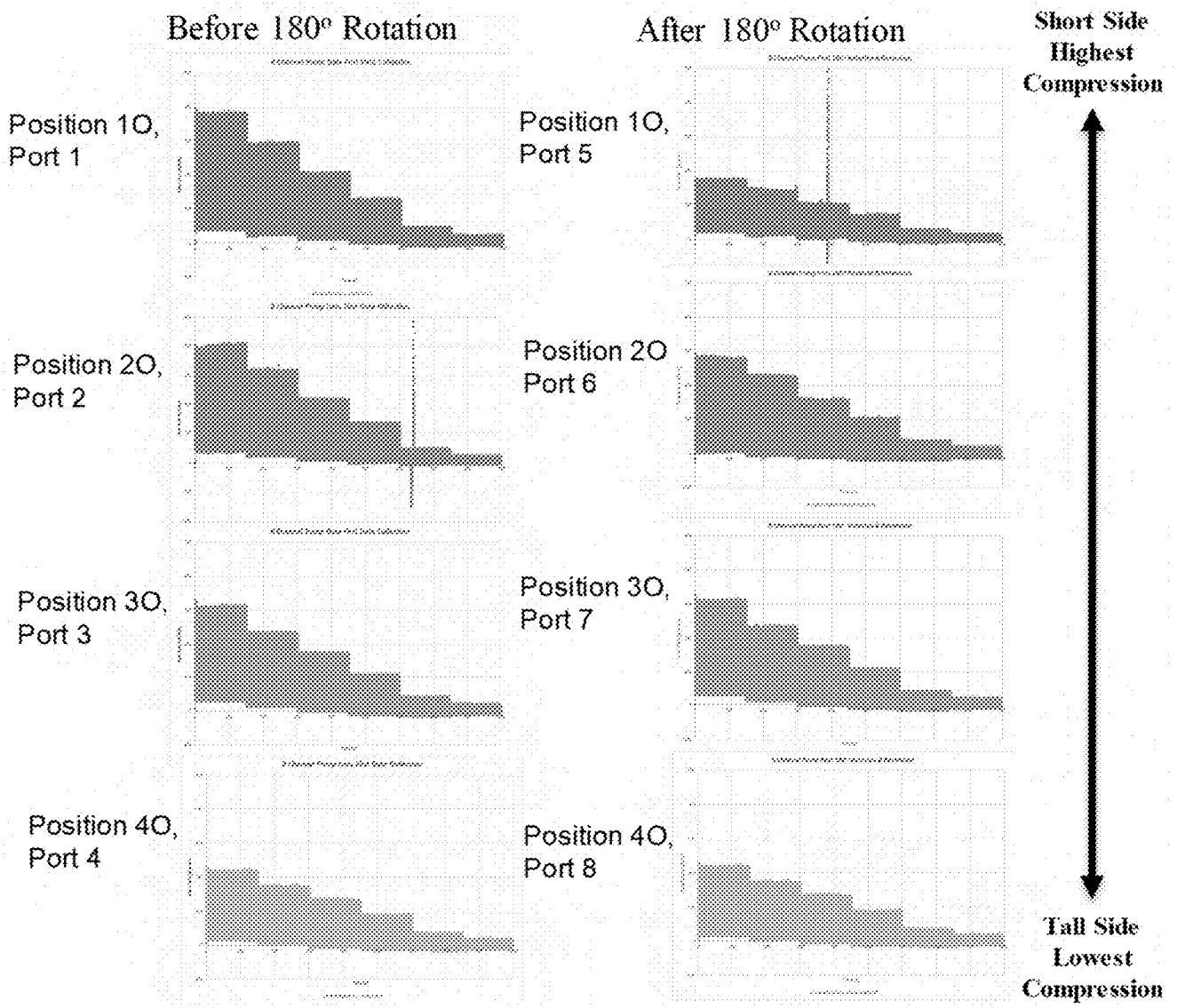

The differences in the flow rates of each pump arose either from non-planarity of the molded fluidic chip, or manufacturing tolerances in the motor cartridge components. To test whether the flow rate differences was due to fluidic planarity or to hardware of the pump motor frame, the pump was rotated 180°, and it was determined that one side of the fluidic chip exhibited less compression of the channels than the other. FIGS. 5E and 5F show how the outputs of the eight pumps depended upon rotation of the fluidic chip as shown in FIG. 4A. It was concluded from these tests that the differences primarily from the manufacturing tolerances of motor cartridge components, which could be readily tightened.

Figures 6A, 6B, 6C, 6D:
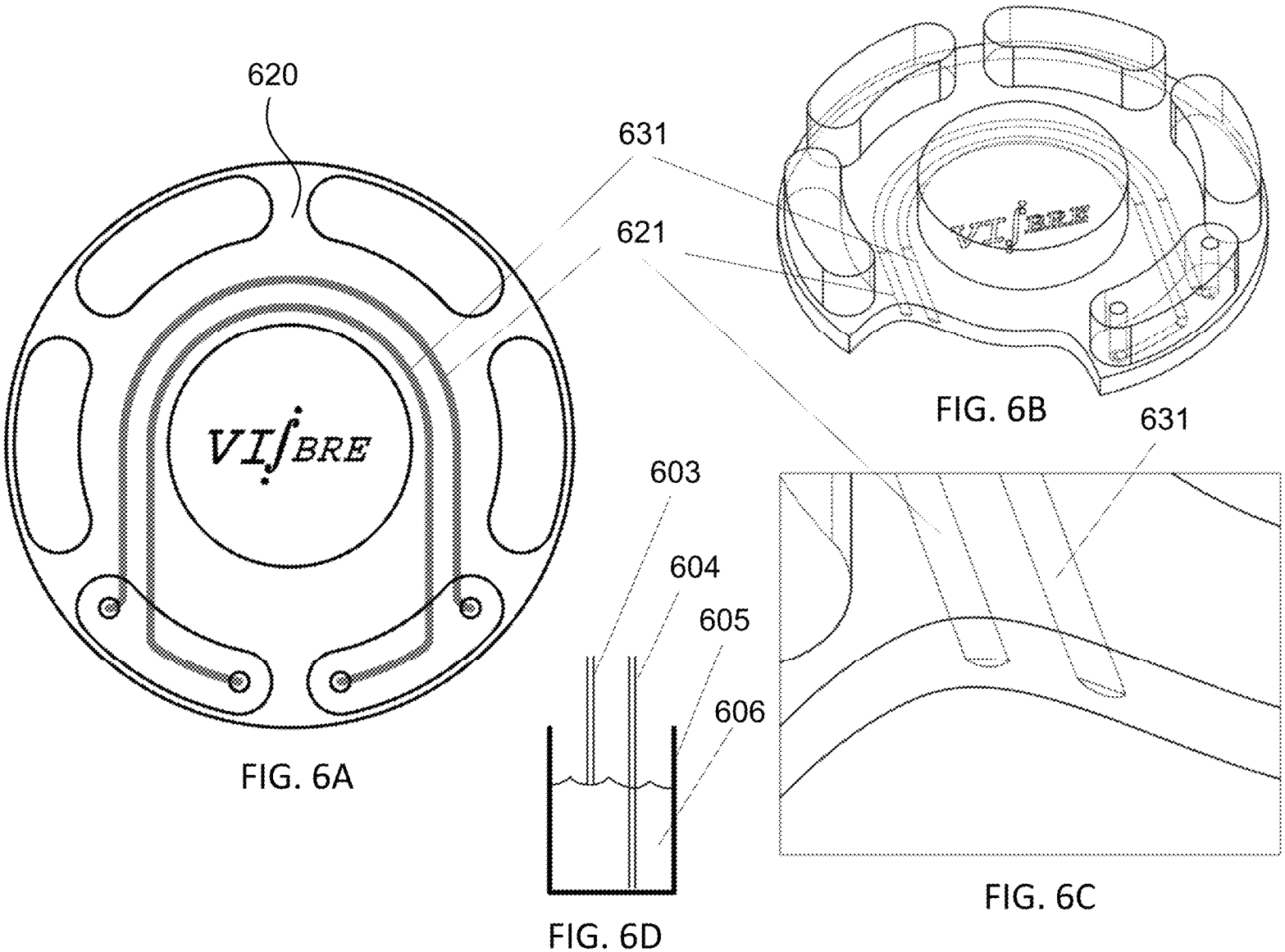
FIGS. 6A-6C show various views of a 6-channel push-pull pump according to embodiments of the invention.
FIG. 6D shows schematically a reservoir into which fluid is delivered and from which fluid is removed through tubes to a 6-channel push-pull pump according to embodiments of the invention.

When using pumps to fill or empty a small volume, such as a well in a 96-well plate, the amount of fluid delivered and fluid removed must be carefully controlled, lest the well be either inadvertently over-filled or emptied. FIGS. 6A-6C shows schematically various views of a push-pull pump chip 620 according to one embodiment of the invention. This chip 620 may be connected to tubes 603, 604 in a reservoir 605 as shown in FIG. 6D, and is designed to continually supply and maintain its volume. The pump chip features two isolated channels-aspiration channel 621 and an injection channel 6-31, whose actuated lengths (and therefore volume, and therefore flowrate) differ by nature of their differing radiuses. Isolated channels 631, 621 are actuated by a single roller head (not shown) with aspiration circuit 621 designed to pump at 20% higher rate than injection circuit 631, so that the depth of liquid 606 contained in reservoir 605 never exceeds the elevation of the mouth of aspiration straw 603. This can, in one embodiment, be accomplished or adjusted by making the channels either wider or deeper. A double-ridge (not shown) superimposed over channels 631, 621 may be incorporated to reduce friction and improve actuator-to-channel alignment tolerance. The push-pull pump can be used without any modification in the motor cartridges described above. The embodiment shown could be used to maintain fresh culture media in each of 24 wells of a transwell culture of a bioprinted tissue construct (e.g., skin) for long periods of time without the need to remove the well plate from an incubator. This design allows a single pumping channel 631 to deliver the media at the desired flow, with the fluid level not set by the speed of the aspiration pump channel 621 but by the height of the aspiration channel 603.

Figure 7B:
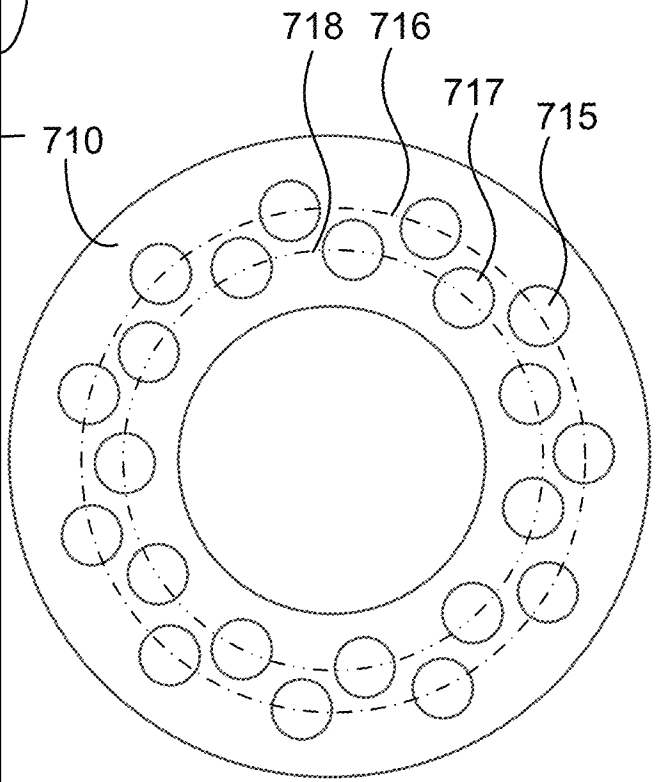
FIGS. 7A-7B shows schematically a 12-channel peristaltic micropump that can function as a six-channel push-pull micropump according to embodiments of the invention.
Figure 7A:
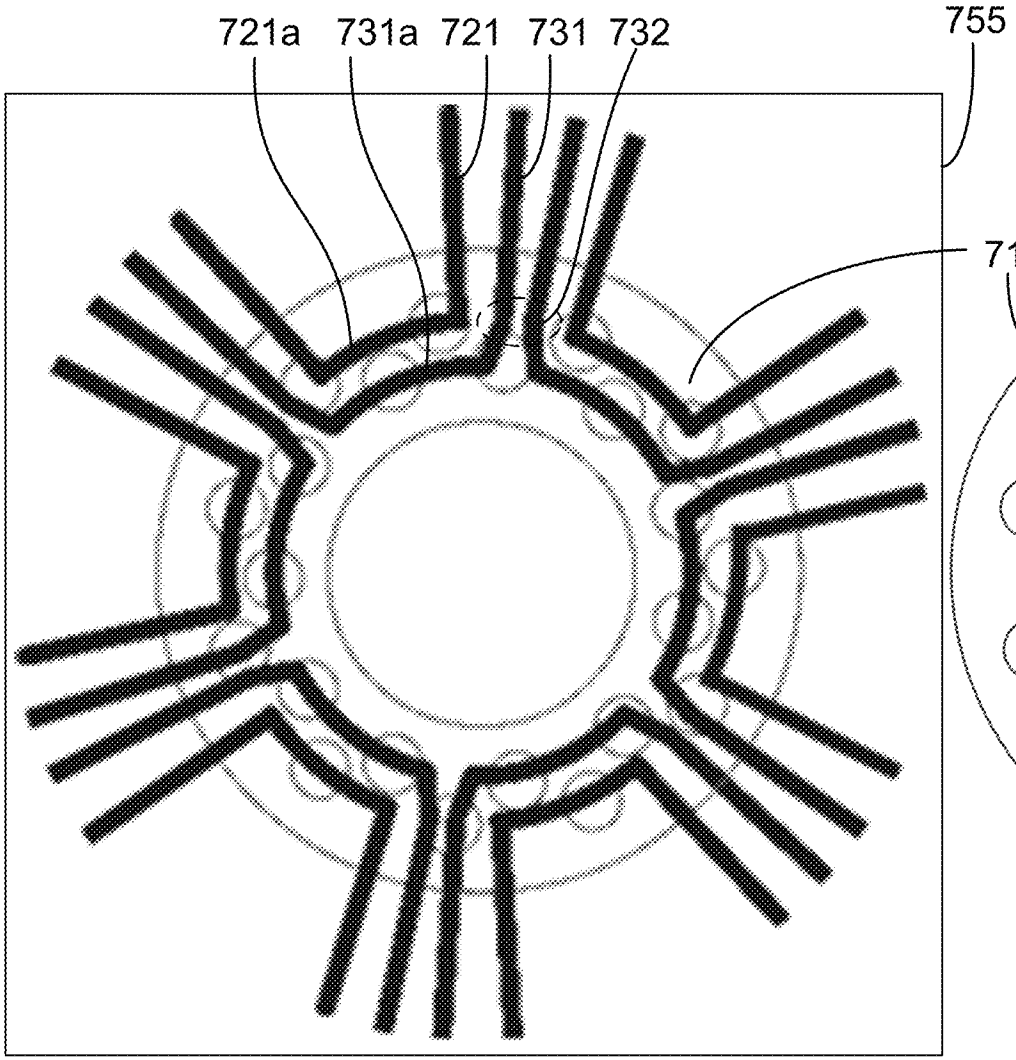

Three eight-channel pumps as shown in FIG. 2A or twelve push pull pumps as shown in FIG. 6A could be used to deliver and remove fluid from a 12-well plate containing, for example, skin that was bioprinted on Transwell inserts. FIGS. 7A-7B show a conceptual drawing for a six-channel push-pull pump and actuator that could do the same with only two motors to deliver and remove fluid from each well of a twelve-well plate. Four motors and a single four-motor controller could address a 24-well plate. This layout has the same angular spacing on the outer race as the eight-port pump.

As shown in FIGS. 7A-7B, the pump chip 755 has twelve channels with six outer channels 721 and six inner channels 731 and an actuator 710 with eleven outside balls 715 placed on along a circular, outside ball track 716 of a bearing cage and eleven inside balls 717 placed along a circular, inside ball track 718 of the bearing cage. Each of the six outer channels 721 has a middle, circumferential portion 721*a* aligned in a circle that is operably under the outside ball track 716, and each of the six inner channels 731 has a middle, circumferential portion 731*a* aligned in a circle that is operably under the inside ball track 718. Other number of the inside and outside balls can also be utilized to practice the invention, as long as a number of balls (actuating members) is sufficient so that during the course of a full rotation no channel ever has no balls compressing it, thereby guaranteeing continuous pumping action with no depressurization of the downstream, pumped device, as could happen were a channel transiently open.

In one embodiment, the inner channels 731 have direct access to the outside of the pump fluidic chip. The reduction from eight to six channels provides the space required for the inner channels 731 to cross to the outside. Traces coming from the inside race 732 past the outside ball track 715 and may need to be deeper or wider as they cross the outside ball track 716 so as to not have their flow blocked when the outer balls 715 of the actuator 710 cross the channels to the inside. Depending upon the spacing's and compression forces, it might be possible to use a single race of larger balls that blocks both channels at the same time.

Using the through-plate circular chip design, the inner channels could be accessed from the inside of the ball races, and the outer channels from the outside. This would obviate the need to compensate for the outer actuating balls crossing over the fluidics from the inner channel.

In this embodiment of a multichannel pumps, it would be possible to adjust the length of the pumping regions so that all channels on the multichannel pump in FIG. 7B would be pumped at the same flowrate. This, as well as the pump in FIG. 2A, would enable a push-pull multipump to actively deliver and actively remove fluid from one side of a two-chambered bioreactor such as a neurovascular unit. Another channel on the push-pull pump would do the same for the other chamber. This would address the known problem in maintaining balance between both sides of such a reactor, since the chambers are separated by a semi-permeable membrane whose permeability is determined not only by the sizes of the pores but also by the degree of confluence of the cells grown on either or both sides of the membrane. When a pair of standard peristaltic or syringe pumps is used only to deliver fluid to the two chambers, and the passive outflow is governed by the various hydraulic resistances in the bioreactor and tubing, it is often the case that while identical flows are delivered to both chambers, the outflows are imbalanced. This indicates that fluid is being pumped not only through one chamber from inlet to outlet, but also across the membrane into the other chamber to its outlet. This cross-membrane flow can be deleterious to the cells being cultured on the membrane and can adversely affect the validity of the bioreactor as a model, for example, of a neurovascular unit. Hence a pair of matched push-pull pumps would drive each two-chamber bioreactor, and the number of bioreactors serviced by a single multi-pump would depend upon the number of push-pull pump pairs on the fluidic chip.

In certain embodiments, the different type actuators can be also used, which the numbers of actuating members, such as cam followers and rollers, are mounted on shafts (sockets) around a single hub.

Figure 8:
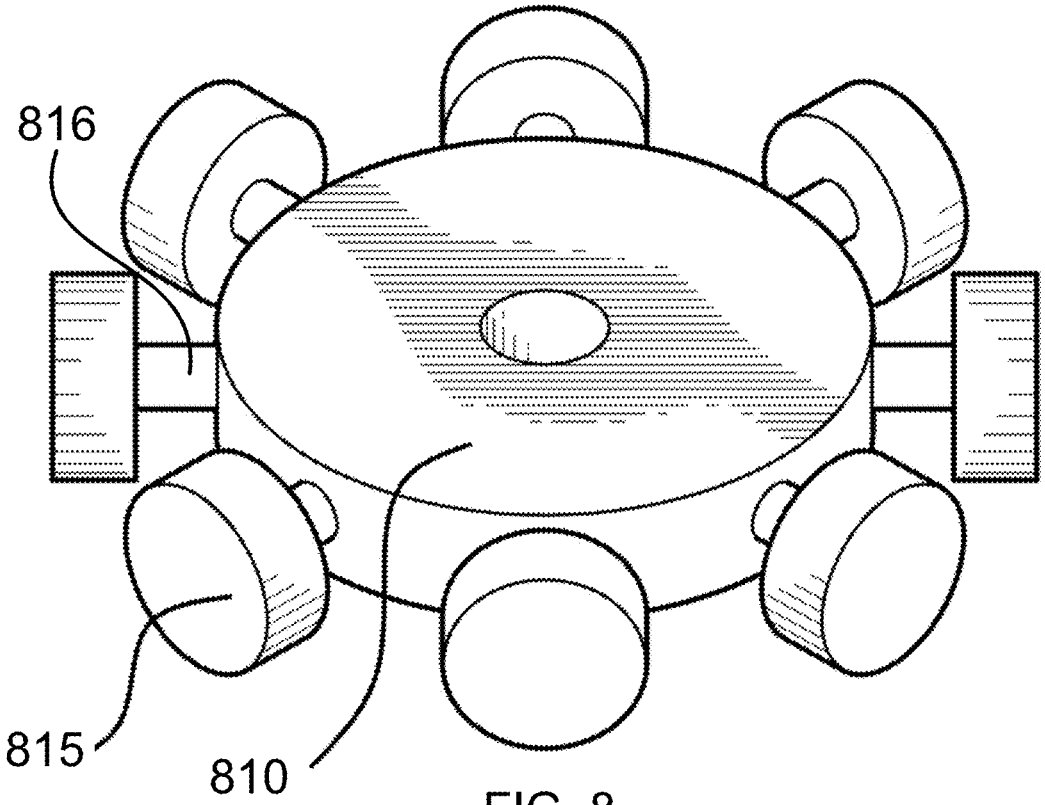
FIG. 8 shows schematically an axle-driven, cam-follower-bearing type actuator used for a peristaltic micropump according to embodiments of the invention.

For example, FIG. 8 shows an axle-driven, cam-follower-bearing type actuator used to implement a multichannel pump according embodiments of the invention, where the actuator has a cam (motorized hub) 810 and a plurality of cam followers 815 spaced-equally mounted onto shafts 816 of the cam 810.

Figure 9:
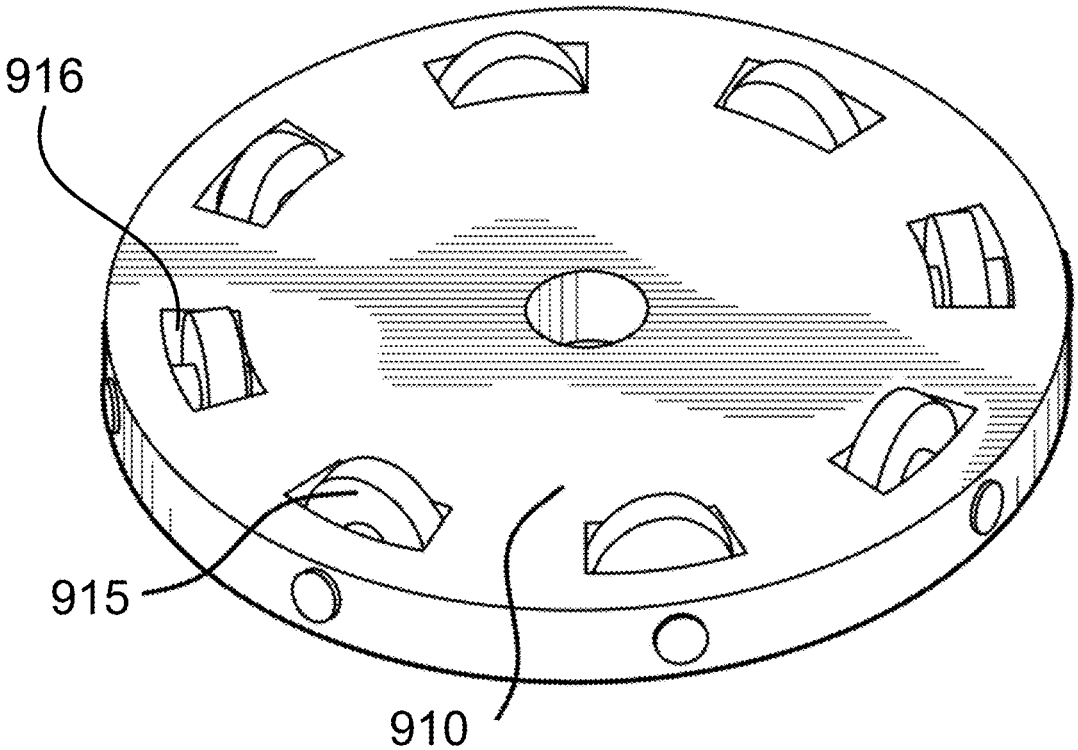
FIG. 9 shows schematically an axle-driven, roller-bearing type actuator used for a peristaltic micropump according to embodiments of the invention.

FIG. 9 shows an axle-driven, roller-bearing type actuator used to implement a multichannel pump according embodiments of the invention, where the actuator has a wheel (motorized hub) 910 and a plurality of rollers 915 mounted into the spaced-equally sockets 916 of the wheel 910.

Figure 10:
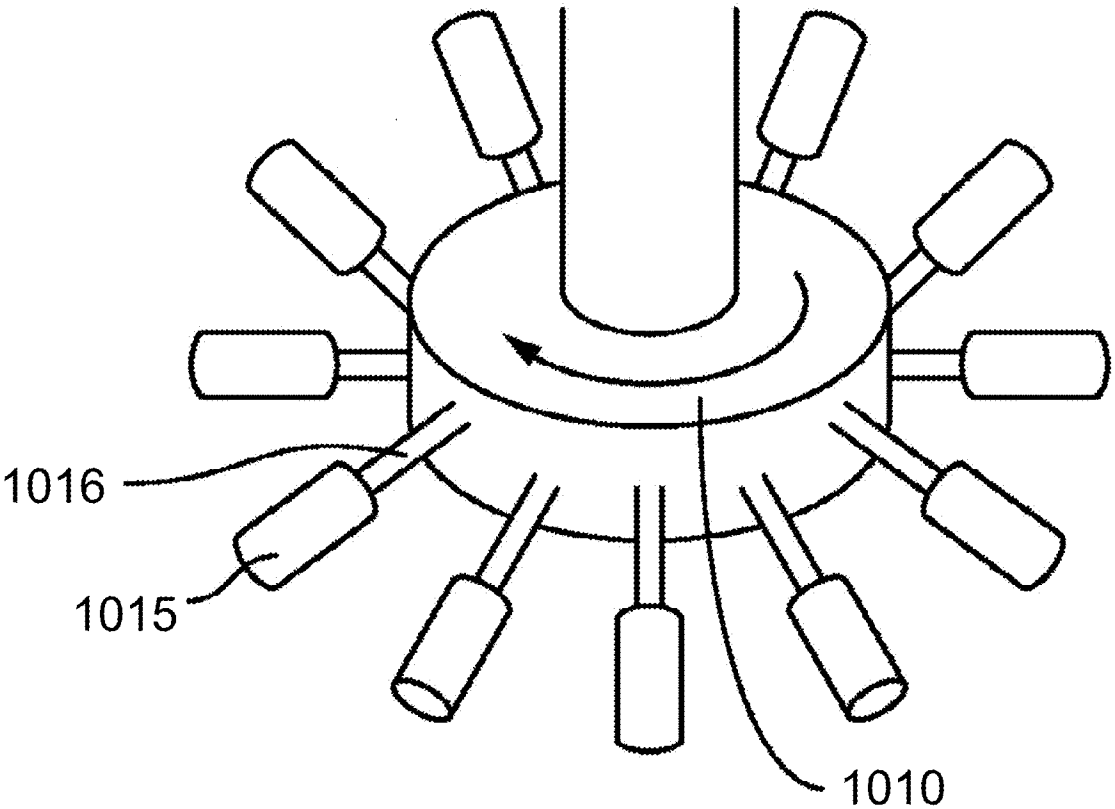
FIG. 10 shows schematically a hub type actuator used for a peristaltic micropump according to embodiments of the invention.

FIG. 10 shows another embodiment of an actuator to implement a multichannel pump according to the invention, which includes a motorized hub 1010 and a plurality of cylindrical rollers 1015 mounted into spaced-equally mounted onto shafts 1016 of the hub 1010.

Figure 11B:
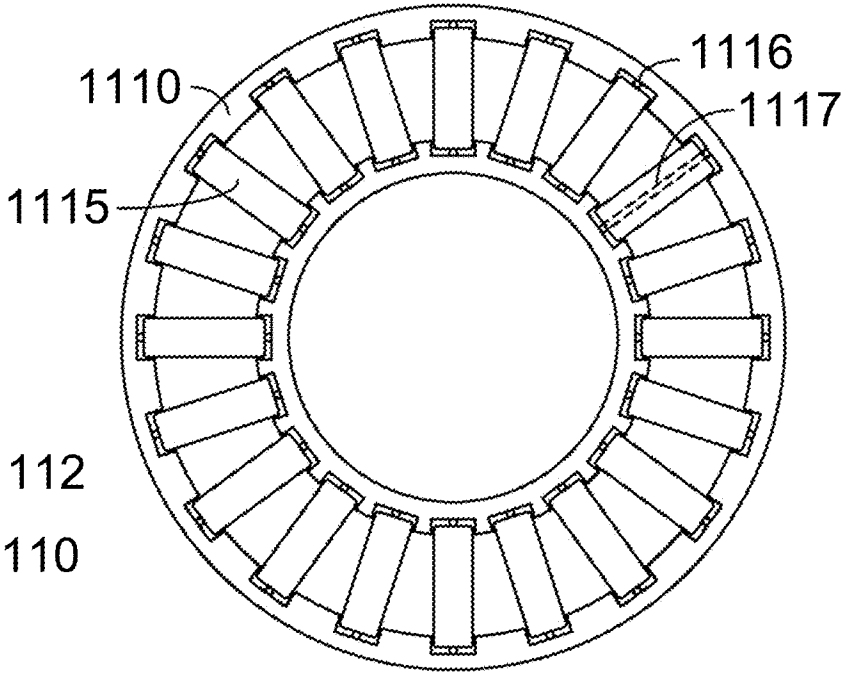
FIGS. 11A-11B show schematically a roller thrust bearing cage type actuator used for a peristaltic micropump according to embodiments of the invention.
Figure 11D:
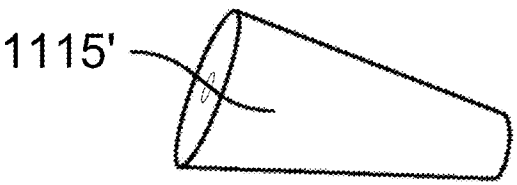
FIGS. 11C-11D show respectively a cylindrical roller and a conical roller used for a peristaltic micropump according to embodiments of the invention.
Figure 11A:
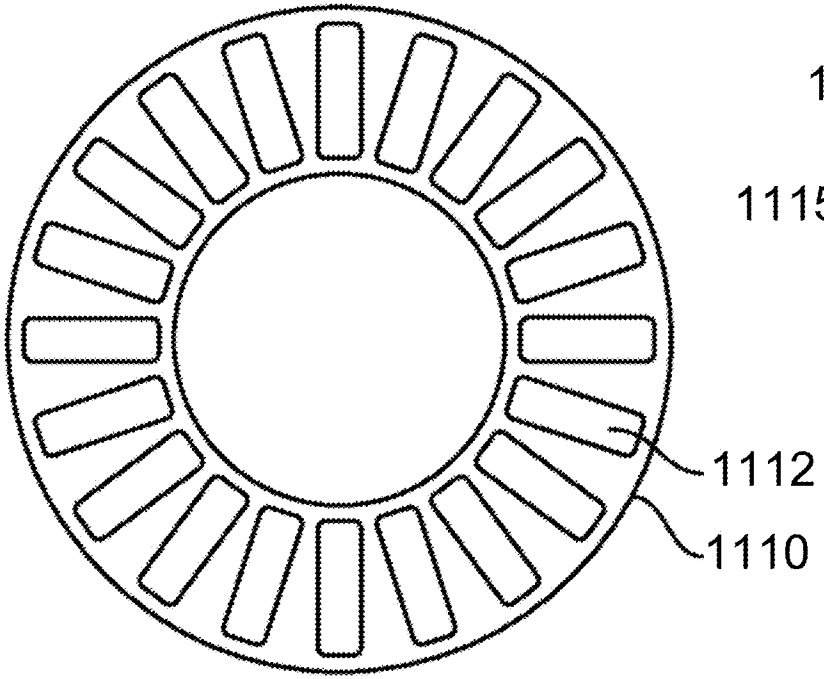
Figure 11C:
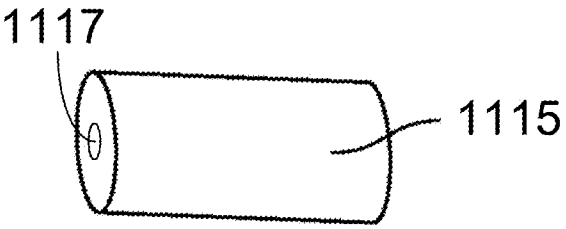

FIGS. 11A-11C shows yet another embodiment of an actuator to implement a multichannel pump according to the invention. The actuator has a roller thrust bearing cage 1110 having a plurality of sockets 1112 and rolling members configured as cylindrical rollers 1115 coupled, for example, to the cage via pins 1116 that pass through a central hole 1117 in each of the cylindrical rollers 1115. In one embodiment shown in FIG. 11D, the cylindrical rollers 1015 (FIG. 10) or 1115 (FIG. 11B-11C) may be replaced with conical rollers 1115'.

For such multichannel pumps as disclosed above, when the actuator rotates, the rolling members are also rotating relative to the rolling bearing cage and middle, circumferential channel portions of the multiple channels. During operation, rolling members, such as 815, 915, 1015, 1115 or 1115', engage and compress the middle, circumferential channel portions of the multiple channels and pump fluids through the multiple channels simultaneously at different flowrates. When the pump is not in operation, one or more rolling members placed on the circumferential channel portions of the multiple channels prevent passive forward or reverse flow through the pumps.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A push-pull micropump, comprising:

one or more pairs of channels configured to transfer one or more fluids, each channel pair having an aspiration channel and an injection channel, wherein each channel has a middle channel portion, and wherein the middle channel portions of the aspiration and injection channels of each channel pair are arranged as segments of two concentric circles with different radii; and an actuator configured to engage the one or more pairs of channels, wherein the actuator comprises a plurality of rolling members and a driving member configured such that when the driving member rotates, the plurality of rolling members rolls along the one or more pairs of channels to cause individually the one or more fluids to transfer through each channel pair simultaneously at different flowrates or the same flowrate, depending upon width, depth, or actuated lengths of the aspiration and injection channels of each channel pair, wherein an actuated length of a channel is defined by a length of the channel along which the plurality of rolling members rolls during a full rotation of the driving member, wherein the driving member comprises a bearing cage defining a plurality of spaced-apart openings thereon, and the plurality of rolling members is accommodated in the plurality of spaced-apart openings; and wherein the plurality of spaced-apart openings defines two concentric circles that are operably coincident with said two concentric circles of the middle channel portions of the one or more pairs of channels.

2. The push-pull micropump of claim 1, wherein each channel pair is configured such that the actuated length of the aspiration channel is longer than that of the injection channel, whereby the aspiration and injection channels of each channel pair have different flowrates.

3. The push-pull micropump of claim 1, wherein each channel pair is configured such that the actuated length of the aspiration channel is same as that of the injection channel, whereby the aspiration and injection channels of each channel pair have the same flowrate.

4. The push-pull micropump of claim 1, wherein when the driving member rotates about a central axis, each rolling member operably rolls about a respective axis that is not parallel to the central axis.

5. The push-pull micropump of claim 1, wherein each of the plurality of rolling members comprises a ball, or a roller.

* * * * *